US007677215B2

(12) United States Patent
Yamaguchi et al.

(10) Patent No.: US 7,677,215 B2
(45) Date of Patent: Mar. 16, 2010

(54) POWER MANAGEMENT DEVICE, CONTROL SYSTEM, AND CONTROL METHOD

(75) Inventors: Kazuhi Yamaguchi, Kobe (JP); Shinichiro Takatomi, Kobe (JP); Takashi Matsui, Kobe (JP); Shinji Takemoto, Kobe (JP); Shinji Yamashita, Kobe (JP)

(73) Assignee: Fujitsu Ten Limited, Kobe (JP)

( * ) Notice: Subject to any disclaimer, the term of this patent is extended or adjusted under 35 U.S.C. 154(b) by 410 days.

(21) Appl. No.: 11/785,225

(22) Filed: Apr. 16, 2007

(65) Prior Publication Data

US 2007/0245998 A1 Oct. 25, 2007

(30) Foreign Application Priority Data

Apr. 19, 2006 (JP) ..... 2006-115373

(51) Int. Cl.
*F02N 11/08* (2006.01)

(52) U.S. Cl. ..... 123/179.3; 123/198 D

(58) Field of Classification Search ..... 123/179.3, 123/198 D

See application file for complete search history.

(56) References Cited

U.S. PATENT DOCUMENTS 4,006,723 A * 2/1977 Schmidli ..... 123/179.2
4,362,133 A * 12/1982 Malik ..... 477/99
4,490,620 A * 12/1984 Hansen ..... 290/38 R
4,586,467 A * 5/1986 Raver ..... 123/179.3
4,653,442 A * 3/1987 Swenson ..... 123/179.3
4,901,690 A * 2/1990 Cummins et al. ..... 123/179.3
5,182,943 A * 2/1993 Fukui et al. ..... 73/114.27
6,024,065 A * 2/2000 Hojna et al. ..... 123/179.3
6,497,209 B1 * 12/2002 Karuppana et al. ..... 123/179.3
6,609,488 B2 * 8/2003 Nagae et al. ..... 123/179.3
6,794,765 B2 * 9/2004 Izumiura et al. ..... 290/38 R
6,799,546 B1 * 10/2004 Gonring et al. ..... 123/179.3
7,105,944 B2 * 9/2006 Wakitani et al. ..... 307/10.6
7,150,253 B2 * 12/2006 Itou et al. ..... 123/179.3

FOREIGN PATENT DOCUMENTS

JP U 3060902 6/1999
JP A 2002-122058 4/2002
JP A 2003-329719 11/2003
JP A 2004-136816 5/2004
JP A 2005-248859 9/2005
JP A 2006-233917 9/2006
JP A 2007-002812 1/2007

* cited by examiner

*Primary Examiner*—Stephen K Cronin
*Assistant Examiner*—Arnold Castro
(74) *Attorney, Agent, or Firm*—Oliff & Berridge PLC

(57) ABSTRACT

A power management device comprises a start management control unit having a starter hold control function for actuating a starter motor and holding the actuation based on an operating signal from a button switch, a first terminating unit for terminating cranking hold when receiving a starter stop instruction signal sent from an engine control device when it is determined that an engine reached a complete explosion, a second terminating unit for terminating cranking hold when it is determined that the engine reached a complete explosion based on an engine revolution signal sent from the engine control device, and a forced terminating unit for forcefully terminating cranking hold when cranking hold cannot be terminated by those terminating units.

5 Claims, 17 Drawing Sheets

POWER MANAGEMENT DEVICE, CONTROL SYSTEM, AND CONTROL METHOD

BACKGROUND OF THE INVENTION

1. Field of the Invention

The present invention relates to a power management device, a control system, and a control method and, more particularly, to a power management device for managing power supplies, a control system having the power management device and an engine control device, and a method for controlling cranking of a starter.

2. Description of the Relevant Art

In recent years, in order to respond to user needs, comfort and convenience of a vehicle have been rapidly progressing. A push start system developed for improving the convenience when starting an engine is exemplified (see Japanese Registered Utility Model No. 3060902, Japanese Patent Application Laid-Open Publication No. 2002-122058, and Japanese Patent Application Laid-Open Publication No. 2005-248859, for example).

In the push start system, it is unnecessary to insert an engine key into a key cylinder to turn the key to an ST (Starter) position, differently from a mechanical start system, and the engine is started with a push of a button.

FIG. 1 is a block diagram schematically showing a push start system. Reference numeral 1 in FIG. 1 represents a battery. From the battery 1, power is supplied through an ACC relay 2 to ACC (Accessory) units Ua1, Ua2, . . . , and through an IG relay 3 to IG (Ignition) units Ub1, Ub2, . . . . The ACC relay 2 and the IG relay 3 are turned on by the passage of electric current through coils $L_2$ and $L_3$, respectively.

To a starter motor 4, power is supplied through a motor relay 5 from the battery 1. Turning-on/-off of the motor relay 5 is controlled by the passage of electric current through a coil $L_5$. When power is supplied to the coil $L_5$, the motor relay 5 is turned on, the starter motor 4 is actuated, and an engine is started.

Power from the battery 1 is supplied to the coil $L_5$ in cases where an ST relay 7 is turned on while a safety switch 6 is in an ON state. The ST relay 7 is turned on by the passage of electric current through a coil $L_7$. The safety switch 6 is in the ON state in cases where a selector lever is in a P (Parking) position or an N (Neutral) position, or a clutch pedal has been pressed.

Applications of power to the coils $L_2$, $L_3$ and $L_7$ which control turning-on/-off of the ACC relay 2, the IG relay 3, and the ST relay 7 are controlled by a power management device 8. To the power management device 8, the safety switch 6, a button switch 9 to be operated by a driver, and a brake switch (SW) 10 are connected.

When the button switch 9 is pressed while the safety switch 6 is in the ON state and the brake pedal is held down, the power management device 8 applies power to the coils $L_2$, $L_3$ and $L_7$ so as to turn on the ACC relay 2, the IG relay 3 and the ST relay 7.

On the other hand, when the button switch 9 is pressed while the safety switch 6 is in an OFF state, or the brake pedal is not held down, without applying power to the coil $L_7$, only the power condition is changed. For example, when the button switch 9 is pressed while the power condition is an OFF state, power is applied to the coil $L_2$ so as to change the power condition to an ACC state. When the button switch 9 is pressed in the ACC state, power is applied to the coil $L_3$ so as to change the power condition to an IG state. When the button switch 9 is pressed in the IG state, power to the coils $L_2$ and $L_3$ is cut off so as to change the power condition to the OFF state.

An engine control device 11 comprises a start management control unit 14 having an engine complete explosion determining function 12 and a starter hold control function 13. To the engine control device 11, an engine revolution sensor 15 is connected, and therefore, the engine control device 11 can grasp an engine speed. In addition, to the engine control device 11, the safety switch 6 and the ST relay 7 are connected.

When turning-on of the ST relay 7 is detected while the safety switch 6 is in the ON state, the engine control device 11 supplies power to an ST line Ln in order to hold cranking, and the cranking is held (cranking hold). Cranking hold is conducted since power is applied to the coil $L_7$ by the power management device 8 only within a time period during which the button switch 9 has been pressed (i.e. power is not applied to the coil $L_7$ when the button switch 9 is not pressed).

Thus, without the driver's continuing to press the button switch 9, it is possible to continue to drive the starter motor 4. The engine control device 11 determines whether the engine reached a complete explosion (i.e. whether the engine became able to keep revolutions under its own power or not) based on the engine speed or the like, and when determining that the engine reached the complete explosion, a power supply to the ST line Ln is terminated.

By the way, in recent years, owing to integration of vehicle control, it became possible to reduce electronic components to be mounted on a vehicle and further improve the dynamics of the vehicle. For example, an engine control ECU (Electronic Control Unit) and a transmission control ECU are combined into one, so as to conduct engine control at shifting gears. Moreover, lately, it became possible to exercise control over a vehicle such as power management (e.g. torque control) and heat management (e.g. heat control), leading to a higher-level vehicle control system (see Japanese Patent Application Laid-Open Publication No. 2003-329719 and Japanese Patent Application Laid-Open Publication No. 2004-136816, for example).

At present, the start management control function is located in the engine control device 11 as shown in FIG. 1, but it is considered that the function will be located in the power management device 8 in the future, by relocation of functions of vehicle control.

However, since the determination of complete explosion of the engine is influenced by engine conditions (e.g. the type of the engine), it is desired that the engine complete explosion determining function should be included in the engine control device 11 as it is without being moved to the power management device 8. That is because an engine speed to be a criterion of judgment of complete explosion differs depending on the type of the engine, for example.

Therefore, looking ahead, as shown in FIG. 2, it is expected that an engine control device 11*a* comprising a start management control unit 14*a* without a starter hold control function 13, and a power management device 8*b* comprising a start management control unit 14*b* having a starter hold control function 13*b* will make their appearances.

FIG. 3 is a block diagram schematically showing a push start system expected to appear in the future. Here, the same components as those of the push start system shown in FIG. 1 are similarly marked, and are not described below. Reference numeral 8*b* in FIG. 3 represents a power management device, which comprises a start management control unit 14*b* having a starter hold control function 13*b*.

When a button switch 9 is pressed while a safety switch 6 is in an ON state and a brake pedal is held down, the power management device 8*b* applies power to coils $L_2$, $L_3$ and $L_7$ so as to turn on an ACC relay 2, an IG relay 3 and an ST relay 7.

The power management device 8*b*, differently from the conventional power management device 8, holds the application of power to the coil $L_7$ so as to supply power to a starter motor 4 (cranking hold) until receiving a starter stop instruction signal indicating an instruction to terminate cranking hold, sent from an engine control device 11*a* when it is determined that an engine reached a complete explosion. In other words, the power management device 8*b* cuts off a power supply to the coil $L_7$ so as to terminate cranking hold when receiving the starter stop instruction signal sent from the engine control device 11*a*.

From the engine control device 11*a*, not only the starter stop instruction signal but also an engine revolution signal indicating an engine speed is sent to the power management device 8*b*. Therefore, the power management device 8*b* can judge whether the engine has reached a complete explosion or not based on the engine speed. As a result, the power management device 8*b* can cut off the power supply to the coil $L_7$ so as to terminate cranking hold when the engine reached a complete explosion, even if the starter stop instruction signal could not be received (fail-safe processing).

By the way, since the power management device 8*b* conducts power management and the like to exercise control over the vehicle, the power management device 8*b* should not become inoperative. Even if a voltage of a battery 1 decreases below an operating voltage range of the power management device 8*b* (i.e. decreases below a lower limit of voltage required for a normal operation), the power management device 8*b* should not become inoperative. Then, it is necessary to allow the power management device 8*b* to have a boosting circuit so as to normally operate even when the voltage of the battery 1 decreases below the operating voltage range of the power management device 8*b*.

However, since the engine control device 11*a* does not always have a boosting circuit, there is a risk that the power management device 8*b* may be unable to receive a starter stop instruction signal or an engine revolution signal when the voltage of the battery 1 decreases below an operating voltage range of the engine control device 11*a* so as to cause the engine control device 11*a* not to normally operate. One reason why the boosting circuit is not included in the engine control device 11*a* is an increase in cost.

When the power management device 8*b* cannot receive the starter stop instruction signal and the engine revolution signal, power is applied to the coil $L_7$ for an indefinite time. Even though the engine has reached a complete explosion, cranking, is held. When the cranking is continued even though the engine has reached the complete explosion, there is a risk that a failure of the starter motor 4 may be caused, or that an unusual sound may be caused by the friction between a crankshaft and the starter (a gear), leading to user discomfort. Here, such friction is caused because the starter rotates the crankshaft till a complete explosion of the engine, but in reverse, the starter is rotated by the crankshaft after the complete explosion of the engine.

Moreover, when the voltage of the battery 1 decreases below the operating voltage range of the engine control device 11*a*, or when the engine control device 11*a* suffers a breakdown and runs away, the engine control device 11*a* cannot normally operate and becomes unable to conduct injection control, ignition control and the like, and therefore, there is no need to drive the starter. If the starter is continuously driven in such situation, a degradation speed of the battery 1 will be increased, resulting in shortening the life expectancy of the battery 1.

SUMMARY OF THE INVENTION

The present invention was accomplished in order to solve the above problem, and it is an object of the present invention to provide a power management device, a control system, and a control method, whereby cranking can be appropriately controlled even if an engine control device became unable to normally operate, resulting in an improvement in drivability and a restraint on degradation of a battery.

In order to achieve the above object, a power management device according to a first aspect of the present invention is characterized by comprising a cranking control unit operable to bring a starter for starting an engine to cranking and hold the cranking based on an operating signal output with an operation of a switch, a first hold terminating unit operable to terminate cranking hold when receiving a starter stop instruction signal indicating an instruction to terminate cranking hold sent from an engine control device when it is determined that the engine reached a complete explosion, a second hold terminating unit operable to terminate cranking hold when it is determined that the engine reached a complete explosion based on an engine revolution signal sent from the engine control device, a judging unit for judging whether or not cranking hold can be terminated by the first hold terminating unit or the second hold terminating unit, and a third hold terminating unit operable to terminate cranking hold when it is judged by the judging unit that cranking hold can be terminated by neither the first hold terminating unit nor the second hold terminating unit.

When the power management device according to the first aspect of the present invention is used, cranking hold is terminated when it is determined that the engine reached a complete explosion based on an engine revolution signal. Therefore, when an engine revolution signal can be received, cranking hold can be terminated without delay after a complete explosion of the engine, even if a starter stop instruction signal cannot be received.

By the way, when a battery voltage decreases below an operating voltage range of the engine control device, not only a starter stop instruction signal but also an engine revolution signal cannot be received. When neither the starter stop instruction signal nor the engine revolution signal can be received, whether the engine reached a complete explosion cannot be determined, and therefore, cranking is held even though the engine has reached the complete explosion.

However, by using the power management device according to the first aspect of the present invention, when it is judged that cranking hold can be terminated by neither the first hold terminating unit nor the second hold terminating unit (e.g. neither a starter stop instruction signal nor an engine revolution signal can be received), cranking hold is forcefully terminated. As a result, it is possible to prevent an event where cranking is held for an indefinite time even though the engine has reached a complete explosion, leading to a failure of a starter motor, or an occurrence of an unusual sound, which causes user discomfort.

A power management device according to a second aspect of the present invention is characterized by comprising a cranking control unit operable to bring a starter for starting an engine to cranking and hold the cranking based on an operating signal output with an operation of a switch, a first hold terminating unit operable to terminate cranking hold when receiving a starter stop instruction signal indicating an instruction to terminate cranking hold sent from an engine control device when it is determined that the engine reached a complete explosion, a second hold terminating unit operable to terminate cranking hold when it is determined that the engine reached a complete explosion based on an engine revolution signal sent from the engine control device, a failure judging unit for judging whether or not the engine control device is in a state of failure or operation stop, and a third hold terminating unit operable to terminate cranking hold when it is judged that the engine control device is in a state of failure or operation stop by the failure judging unit.

When the power management device according to the second aspect of the present invention is used, cranking hold is terminated when it is determined that the engine reached a complete explosion based on an engine revolution signal. Therefore, when an engine revolution signal can be received, cranking hold can be terminated without delay after a complete explosion of the engine, even if a starter stop instruction signal cannot be received.

Furthermore, by using the power management device according to the second aspect of the present invention, when it is judged that the engine control device is in a state of failure or operation stop, cranking hold is forcefully terminated. When the engine control device suffers a breakdown and runs away, or stops operating, the engine control device becomes unable to conduct injection control, ignition control and the like, and therefore, there is no need to continue to drive the starter. If the starter is continuously driven in such situation, a degradation speed of a battery will be increased, resulting in shortening the life expectancy of the battery. Consequently, it is possible to restrain battery degradation by avoiding the starter from being uselessly driven.

A power management device according to a third aspect of the present invention is characterized by comprising a starter control unit which conducts control of driving a starter and conducts control of stopping the starter based on a signal sent from an electronic control device for controlling an engine, conducting control of stopping the starter when a voltage supplied by a battery decreases to or below a prescribed range during driving of the starter.

When the power management device according to the third aspect of the present invention is used, the starter is stopped based on a signal sent from the electronic control device after the starter was driven.

By the way, when the voltage supplied by the battery decreases below an operating voltage range of the electronic control device, the signal is not sent from the electronic control device. When the signal cannot be received, the driving of the starter is held as it is even though the engine has reached a complete explosion.

By using the power management device according to the third aspect of the present invention, when the voltage supplied by the battery decreases to or below the prescribed range during driving of the starter (e.g. when the voltage supplied by the battery decreases to or below an operating voltage range of the electronic control device, leading to a high possibility that the signal cannot be received), the starter is stopped. As a result, it is possible to prevent an event where driving of the starter is held for an indefinite time even though the engine has reached a complete explosion, leading to a failure of a starter motor, or an occurrence of an unusual sound, which causes user discomfort.

A power management device according to a fourth aspect of the present invention is characterized by comprising a starter control unit which conducts control of driving a starter and conducts control of stopping the starter based on a signal sent from an electronic control device for controlling an engine, conducting control of stopping the starter when a voltage supplied by a battery decreases to or below an operating voltage range of the electronic control device during driving of the starter.

When the power management device according to the fourth aspect of the present invention is used, the starter is stopped based on a signal sent from the electronic control device after the starter was driven.

Moreover, when the voltage supplied by the battery decreases to or below the operating voltage range of the electronic control device during driving of the starter (i.e. when the signal cannot be received), the starter is stopped. As a result, it is possible to prevent an event where driving of the starter is held for an indefinite time even though the engine has reached a complete explosion, leading to a failure of a starter motor, or an occurrence of an unusual sound, which causes user discomfort.

A power management device according to a fifth aspect of the present invention is characterized by comprising a starter control unit which conducts control of driving a starter and conducts control of stopping the starter based on a signal sent from an electronic control device for controlling an engine, conducting control of stopping the starter when a voltage supplied by a battery decreases close to an operating voltage range of the electronic control device during driving of the starter.

When the power management device according to the fifth aspect of the present invention is used, the starter is stopped based on a signal sent from the electronic control device after the starter was driven.

Moreover, when the voltage supplied by the battery decreases close to the operating voltage range of the electronic control device during driving of the starter (e.g. when the signal cannot be received, or when there is a high possibility that the signal may become unable to be received), the starter is stopped. As a result, it is possible to prevent an event where driving of the starter is held for an indefinite time even though the engine has reached a complete explosion, leading to a failure of a starter motor, or an occurrence of an unusual sound, which causes user discomfort.

A power management device according to a sixth aspect of the present invention is characterized by comprising a voltage boosting unit in any one of the power management devices according to the third to fifth aspects of the present invention.

Since the power management device according to the sixth aspect of the present invention has the voltage boosting unit, it is possible to avoid an inoperative situation from being caused by a drop in voltage.

A power management device according to a seventh aspect of the present invention is characterized by a voltage source to the power management device and the electronic control device, which is the battery in any one of the power management devices according to the third to sixth aspects of the present invention.

When the power management device according to the seventh aspect of the present invention is used, whether the voltage supplied by the battery decreased to or below the prescribed range, and whether the voltage supplied by the battery decreased to or below the operating voltage range of the electronic control device can be judged by detecting a voltage supplied by the voltage source.

A control system according to a first aspect of the present invention is characterized by having an engine control device which comprises a first sending unit for sending a starter stop instruction signal indicating an instruction to terminate cranking hold when it is determined that an engine reached a complete explosion and a second sending unit for sending an engine revolution signal, and a power management device which comprises a cranking control unit operable to bring a starter for starting the engine to cranking and hold the cranking based on an operating signal output with an operation of a switch, a first hold terminating unit operable to terminate cranking hold when receiving the starter stop instruction signal sent from the engine control device, a second hold terminating unit operable to terminate cranking hold when it is determined that the engine reached a complete explosion based on the engine revolution signal sent from the engine control device, a judging unit for judging whether or not cranking hold can be terminated by the first hold terminating unit or the second hold terminating unit, and a third hold terminating unit operable to terminate cranking hold when it is judged by the judging unit that cranking hold can be terminated by neither the first hold terminating unit nor the second hold terminating unit.

By using the control system according to the first aspect of the present invention, when it is judged that cranking hold can be terminated by neither the first hold terminating unit nor the second hold terminating unit (e.g. neither a starter stop instruction signal nor an engine revolution signal can be received), cranking hold is forcefully terminated. As a result, it is possible to prevent an event where cranking is held for an indefinite time even though the engine has reached a complete explosion, leading to a failure of a starter motor, or an occurrence of an unusual sound, which causes user discomfort.

A control system according to a second aspect of the present invention is characterized by having an engine control device which comprises a first sending unit for sending a starter stop instruction signal indicating an instruction to terminate cranking hold when it is determined that an engine reached a complete explosion and a second sending unit for sending an engine revolution signal, and a power management device which comprises a cranking control unit operable to bring a starter for starting the engine to cranking and hold the cranking based on an operating signal output with an operation of a switch, a first hold terminating unit operable to terminate cranking hold when receiving the starter stop instruction signal sent from the engine control device, a second hold terminating unit operable to terminate cranking hold when it is determined that the engine reached a complete explosion based on the engine revolution signal sent from the engine control device, a failure judging unit for judging whether or not the engine control device is in a state of failure or operation stop, and a third hold terminating unit operable to terminate cranking hold when it is judged that the engine control device is in a state of failure or operation stop by the failure judging unit.

By using the control system according to the second aspect of the present invention, cranking hold is forcefully terminated when it is judged that the engine control device is in a state of failure or operation stop. When the engine control device suffers a breakdown and runs away, or stops operating, the engine control device becomes unable to conduct injection control, ignition control and the like, and therefore, there is no need to continue to drive the starter. If the starter is continuously driven in such situation, a degradation speed of a battery will be increased, resulting in shortening the life expectancy of the battery. Consequently, it is possible to restrain battery degradation by avoiding the starter from being uselessly driven.

A control system according to a third aspect of the present invention is characterized by having an electronic control device for controlling an engine, which comprises a communication unit for sending a signal related to starter control, and a power management device comprising a voltage boosting unit and a starter control unit which conducts control of driving a starter and conducts control of stopping the starter based on the signal sent from the electronic control device, conducting control of stopping the starter when a voltage supplied by a battery decreases to or below a prescribed range during driving of the starter.

When the control system according to the third aspect of the present invention is used, the starter is stopped based on a signal sent from the electronic control device after the starter was driven.

Moreover, when the voltage supplied by the battery decreases to or below the prescribed range during driving of the starter (e.g. when the voltage supplied by the battery decreases to or below an operating voltage range of the electronic control device, leading to a high possibility that the signal cannot be received), the starter is stopped. As a result, it is possible to prevent an event where driving of the starter is held for an indefinite time even though the engine has reached a complete explosion, leading to a failure of a starter motor, or an occurrence of an unusual sound, which causes user discomfort.

A control system according to a fourth aspect of the present invention is characterized by the electronic control device, which does not have a voltage boosting unit in the control system according to the third aspect of the present invention.

In the control system according to the fourth aspect of the present invention, since the electronic control device does not have the voltage boosting unit, it is possible to achieve a cost reduction.

Without the voltage boosting unit, a signal related to starter control cannot be sent when the voltage supplied by the battery decreases below the operating voltage range of the electronic control device. However, since the starter is stopped in that case, it is possible to avoid an event where driving of the starter is held for an indefinite time even though the engine has reached a complete explosion.

A control method according to a first aspect of the present invention is characterized by comprising a first step of bringing a starter for starting an engine to cranking and holding the cranking based on an operating signal output with an operation of a switch, a second step of terminating cranking hold when receiving a starter stop instruction signal indicating an instruction to terminate cranking hold sent from an engine control device when it is determined that the engine reached a complete explosion, a third step of terminating cranking hold when it is determined that the engine reached a complete explosion based on an engine revolution signal sent from the engine control device, a fourth step of judging whether or not cranking hold can be terminated through the second step or the third step, and a fifth step of terminating cranking hold when it is judged that cranking hold can be terminated through neither the second step nor the third step.

By using the control method according to the first aspect of the present invention, when it is judged that cranking hold can be terminated through neither the second step nor the third step (e.g. neither a starter stop instruction signal nor an engine revolution signal can be received), cranking hold is forcefully terminated. As a result, it is possible to prevent an event where cranking is held for an indefinite time even though the engine has reached a complete explosion, leading to a failure of a starter motor, or an occurrence of an unusual sound, which causes user discomfort.

A control method according to a second aspect of the present invention is characterized by comprising a first step of bringing a starter for starting an engine to cranking and holding the cranking based on an operating signal output with an operation of a switch, a second step of terminating cranking hold when receiving a starter stop instruction signal indicating an instruction to terminate cranking hold sent from an engine control device when it is determined that the engine reached a complete explosion, a third step of terminating cranking hold when it is determined that the engine reached a complete explosion based on an engine revolution signal sent from the engine control device, a fourth step of judging whether or not the engine control device is in a state of failure or operation stop, and a fifth step of terminating cranking hold when it is judged that the engine control device is in a state of failure or operation stop.

By using the control method according to the second aspect of the present invention, cranking hold is forcefully terminated when it is judged that the engine control device is in a state of failure or operation stop. When the engine control device suffers a breakdown and runs away, or stops operating, the engine control device becomes unable to conduct injection control, ignition control and the like, and therefore, there is no need to continue to drive the starter. If the starter is continuously driven in such situation, a degradation speed of a battery will be increased, resulting in shortening the life expectancy of the battery. Consequently, it is possible to restrain battery degradation by avoiding the starter from being uselessly driven.

A control method according to a third aspect of the present invention is characterized by comprising a step of driving a starter and stopping the starter based on a signal sent from an electronic control device for controlling an engine, and a step of stopping the starter when a voltage supplied by a battery decreases to or below a prescribed range during driving of the starter.

When the control method according to the third aspect of the present invention is used, the starter is stopped based on a signal sent from the electronic control device after the starter was driven.

Moreover, when the voltage supplied by the battery decreases to or below the prescribed range during driving of the starter (e.g. when the voltage supplied by the battery decreases to or below an operating voltage range of the electronic control device, leading to a high possibility that the signal cannot be received), the starter is stopped. As a result, it is possible to prevent an event where driving of the starter is held for an indefinite time even though the engine has reached a complete explosion, leading to a failure of a starter motor, or an occurrence of an unusual sound, which causes user discomfort.

DESCRIPTION OF THE PREFERRED EMBODIMENTS

Figure 1:
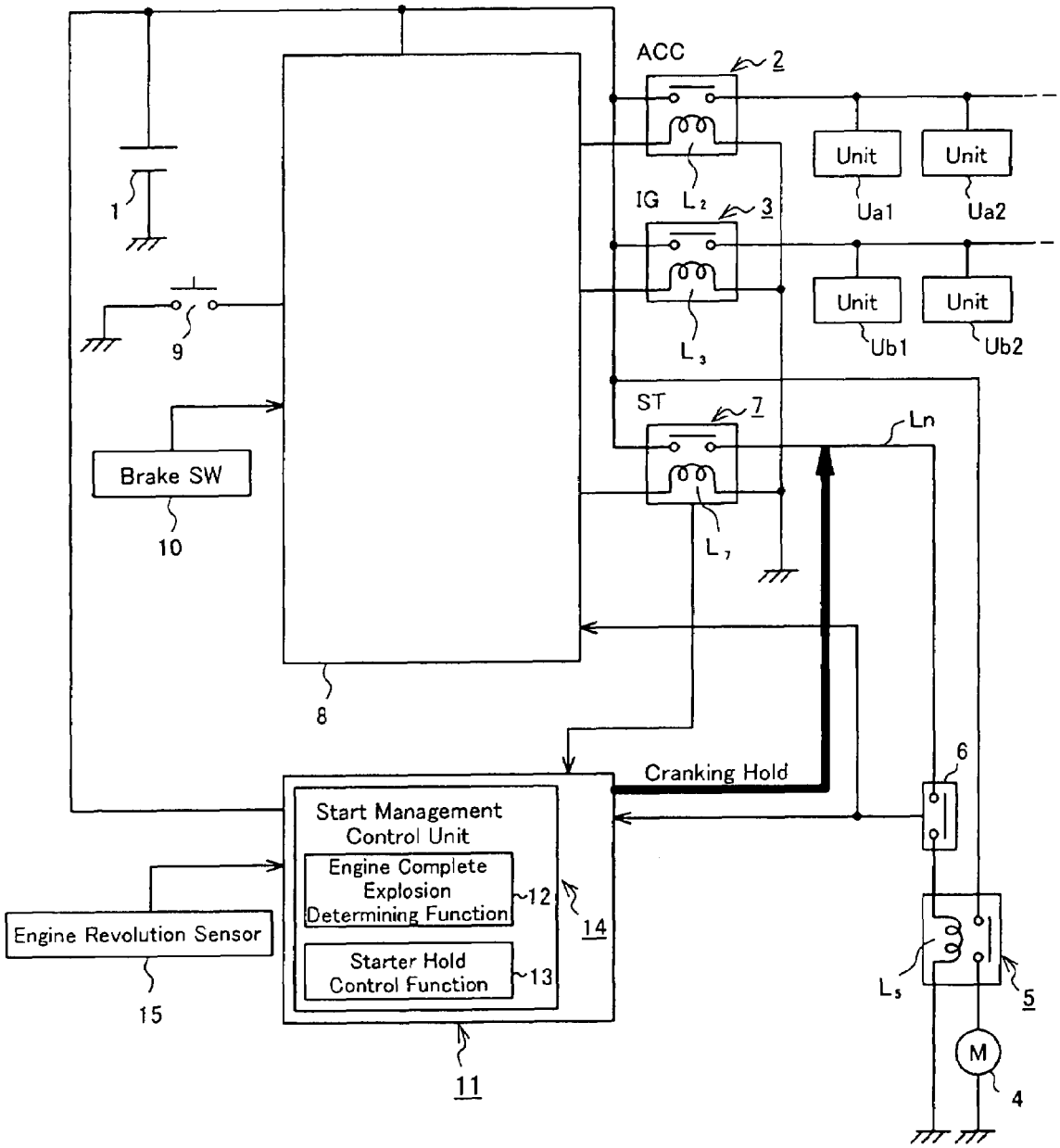
FIG. 1 is a block diagram schematically showing a push start system.
Figure 2:
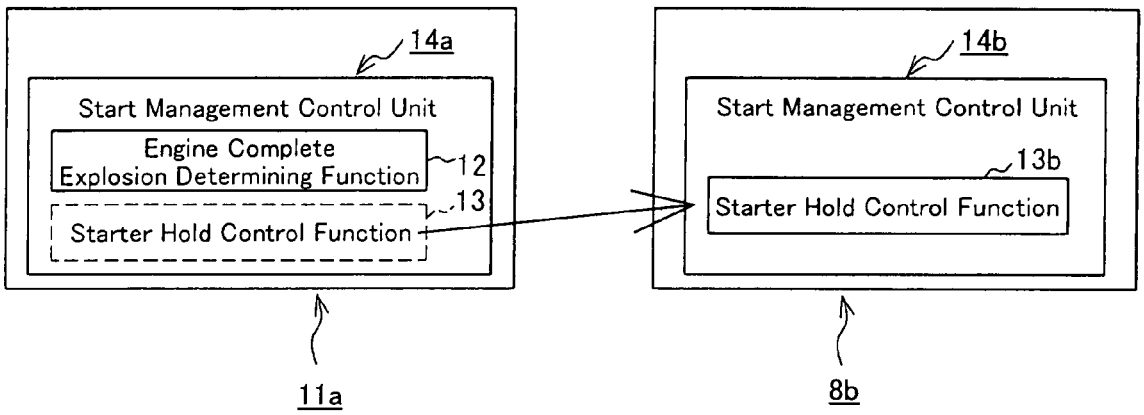
FIG. 2 is an illustration to describe relocation of functions.
Figure 3:
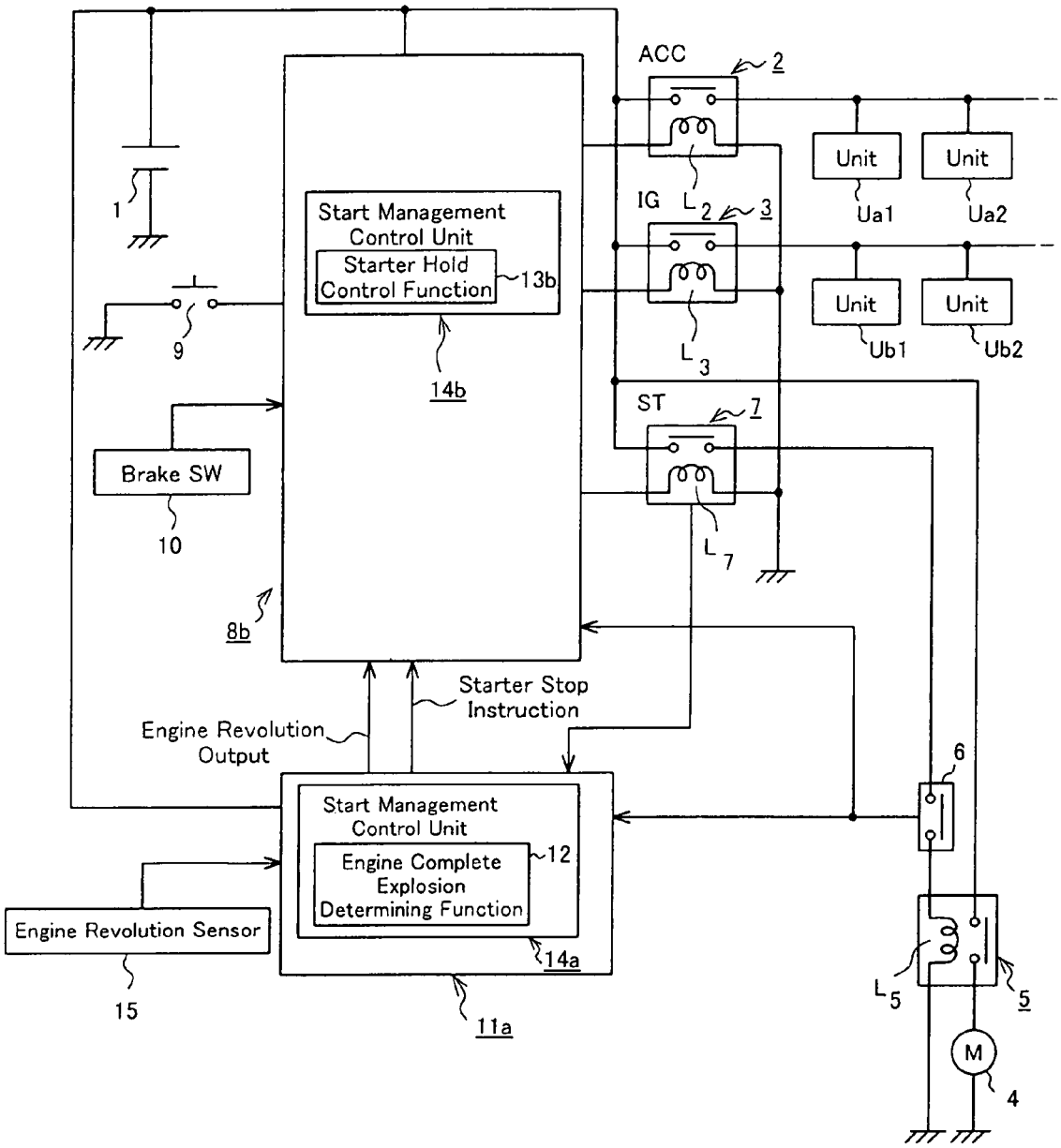
FIG. 3 is a block diagram schematically showing a push start system expected to appear in the future.
Figure 4:
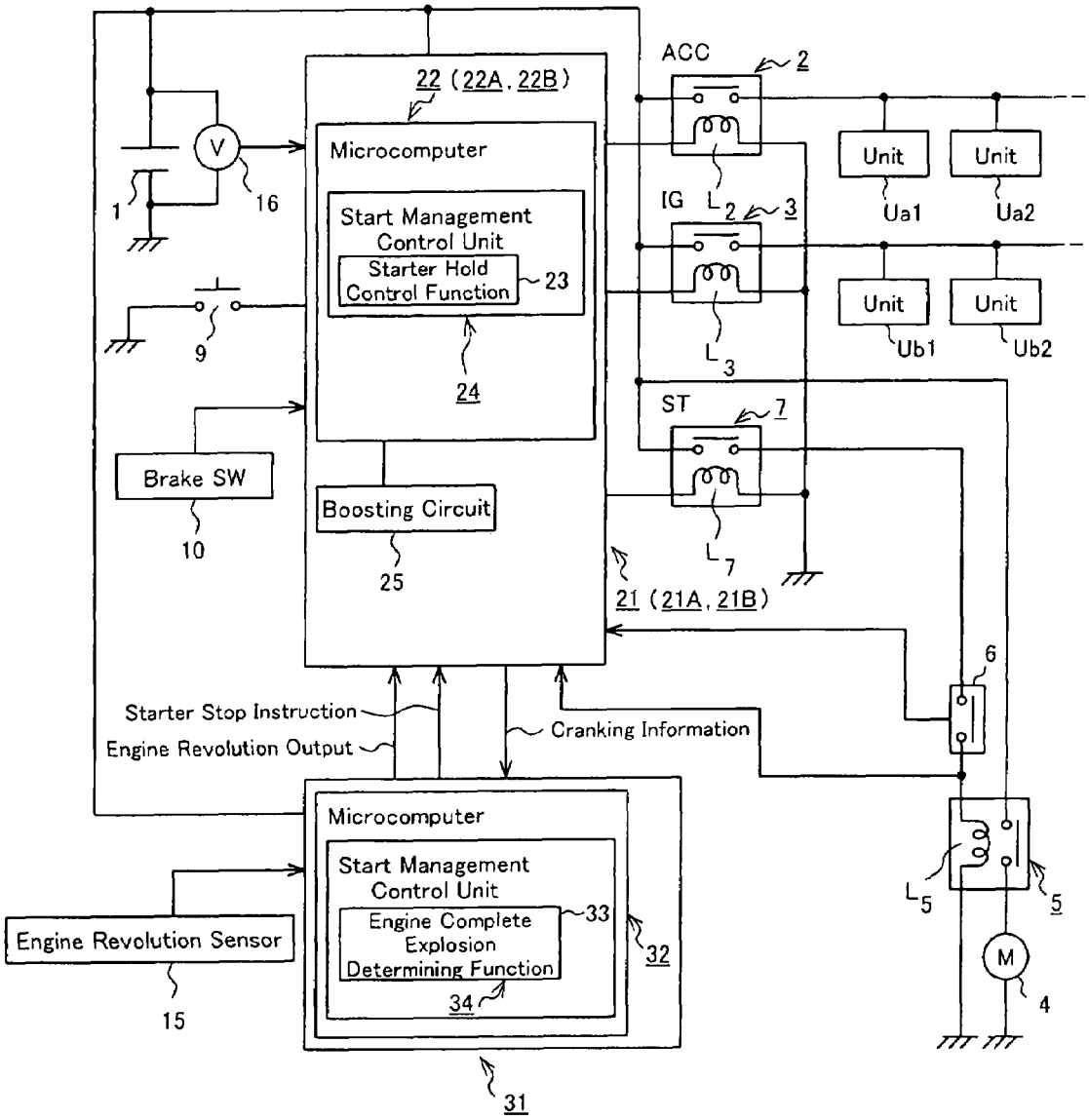
FIG. 4 is a block diagram schematically showing a push start system comprising a power management device according to a first embodiment of the present invention.

The preferred embodiments of the power management device, the control system, and the control method according to the present invention are described below by reference to the Figures noted above. FIG. 4 is a block diagram schematically showing a push start system comprising a power management device according to a first embodiment. Here, the same components as those of the push start system shown in FIG. 1 are similarly marked, and are not described below.

Reference numeral 21 in FIG. 4 represents a power management device, which comprises a microcomputer 22 and a boosting circuit 25. The microcomputer 22 comprises a start management control unit 24 having a starter hold control function 23. When a button switch 9 is pressed while a safety switch 6 is in an ON state and a brake pedal is held down, the power management device 21 applies power to coils $L_2$, $L_3$ and $L_7$ to turn on an ACC relay 2, an IG relay 3 and an ST relay 7, so as to actuate a starter motor 4 and hold the actuation (cranking hold). And cranking information showing that the starter was actuated is sent to an engine control device 31.

A voltage sensor 16 for detecting a voltage $V_{BAT}$ of a battery 1 is connected to the power management device 21, which can grasp the battery voltage $V_{BAT}$. In addition, the power management device 21 monitors the current passage state between the safety switch 6 and a coil $L_5$ so as to be able to judge whether the starter has been driven or not.

The engine control device 31 comprises a microcomputer 32, comprising a start management control unit 34 having an engine complete explosion determining function 33. When receiving the cranking information sent from the power management device 21, the engine control device 31 calculates an engine speed based on an engine revolution pulse obtained from an engine revolution sensor 15, and judges whether an engine has reached a complete explosion or not based on the engine speed and the like. When it is determined that the engine has reached the complete explosion, a starter stop instruction signal indicating an instruction to terminate cranking hold is sent to the power management device 21.

When receiving the starter stop instruction signal sent from the engine control device 31 in cases where it is determined that the engine has reached the complete explosion, the power management device 21 cuts off a power supply to the coil $L_7$ so as to terminate cranking.

Moreover, not only the starter stop instruction signal but also an engine revolution signal showing an engine speed is sent from the engine control device 31 to the power management device 21. Accordingly, the power management device 21 can judge whether the engine has reached a complete explosion or not based on the engine speed. As a result, even if the starter stop instruction signal cannot be received, the power management device 21 can cut off a power supply to the coil $L_7$ so as to terminate cranking hold when the engine reached the complete explosion (fail-safe processing).

Figure 5:
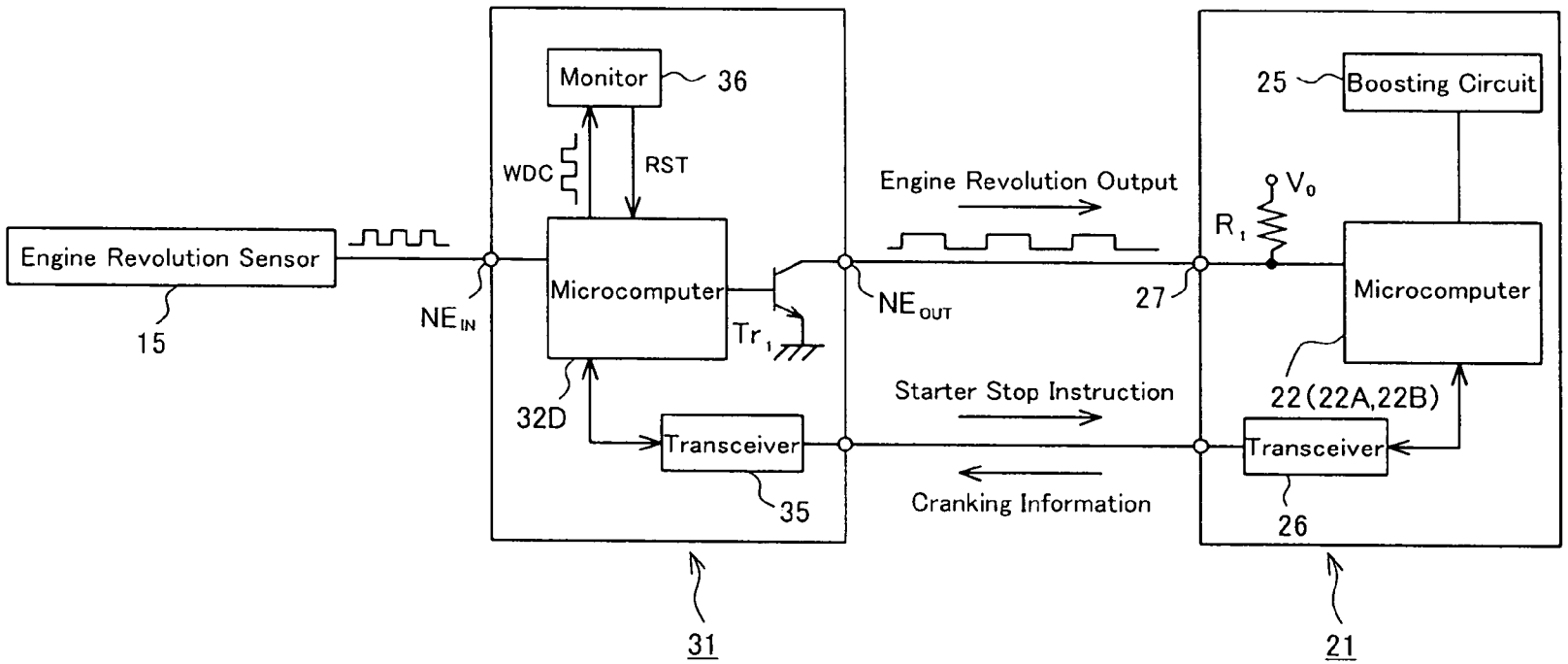
FIG. 5 is a block diagram to describe the power management device according to the first embodiment in more detail.

FIG. 5 is a block diagram to describe the power management device and the engine control device according to the first embodiment in more detail. Here, a system comprising the power management device 21 and the engine control device 31 is parallel to a control system according to the present invention. The power management device 21 has the microcomputer 22, the boosting circuit 25, and a transceiver (transmitter receiver) 26, while the engine control device 31 has the microcomputer 32, a transceiver 35, and a monitor 36 for monitoring whether the microcomputer 32 is normally operating or not.

The power management device 21 and the engine control device 31 can communicate therebetween through the transceivers 26 and 35. As data sent from the power management device 21 through the transceiver 26 to the engine control device 31, cranking information is exemplified. As data sent from the engine control device 31 through the transceiver 35 to the power management device 21, a starter stop instruction signal is exemplified. In addition, one frame of data is sent at established periods (e.g. every 12 msec) from the engine control device 31 through the transceiver 35 to the power management device 21. Therefore, when the transceiver 26 cannot receive data (e.g. when the transceiver 26 cannot receive 3 frames of data, i.e. cannot receive data for 36 msec or more), there is a high possibility of an occurrence of an abnormal condition in the communication system.

The microcomputer 32 of the engine control device 31 can acquire an engine revolution signal from the engine revolution sensor 15. In order to improve the precision of engine control, a pulse signal is generated at every turn of 10° by the engine revolution sensor 15, and an interrupt occurs at an input terminal $NE_{IN}$ at every turn of 10°. The microcomputer 32 conducts soft processing on the pulse signals so as to generate a pulse signal at every turn of 30° and outputs an engine revolution signal through a transistor $Tr_1$ from an output terminal $NE_{OUT}$.

The microcomputer 22 of the power management device 21 can acquire an engine revolution signal sent from the engine control device 31. An interrupt occurs at an input terminal 27 at every turn of 30°. Here, to a line to which an engine revolution signal is output, a constant voltage power source $V_0$ (e.g. 5V) is connected through a load resistance $R_1$. The above-described soft processing is conducted in order to reduce the frequency of occurrence of interrupts to the power management device 21.

From the microcomputer 32 of the engine control device 31, a watchdog signal (WDC) is sent to the monitor 36. The pulse of the WDC is inverted at specified periods (e.g. 4 msec). Accordingly, when the pulse inversion period is different from the specified period (including the case of no inversion), it can be said that the microcomputer 32 is not normally operating. When judging that the microcomputer 32 is not normally operating (i.e. suffering a failure and running away), the monitor 36 sends a reset signal (RST) to the microcomputer 32. When receiving the reset signal, the microcomputer 32 resets itself to attempt to return from the failure.

Figure 6:
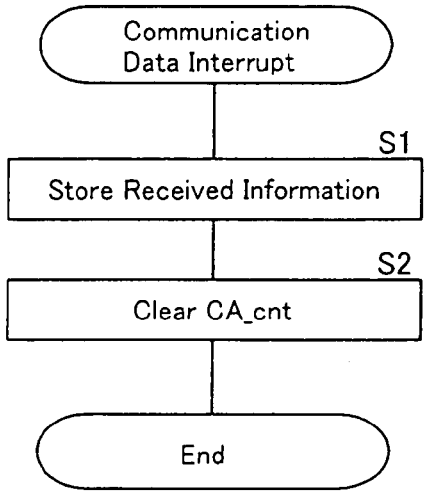
FIG. 6 is a flowchart showing a processing operation performed by a microcomputer of the power management device according to the first embodiment.

A processing operation [1-1] performed by the microcomputer 22 of the power management device 21 according to the first embodiment is described below with a flowchart shown in FIG. 6. Here, this processing operation [1-1] is interrupt processing performed when information sent from the engine control device 31 was received through the transceiver 26.

When information (e.g. a starter stop instruction signal) sent from the engine control device 31 was received, the received information is stored in a buffer memory (not shown) (Step S1), and a timer counter CA_cnt for measuring a time during which no communication data is received is cleared (Step S2).

Figure 7:
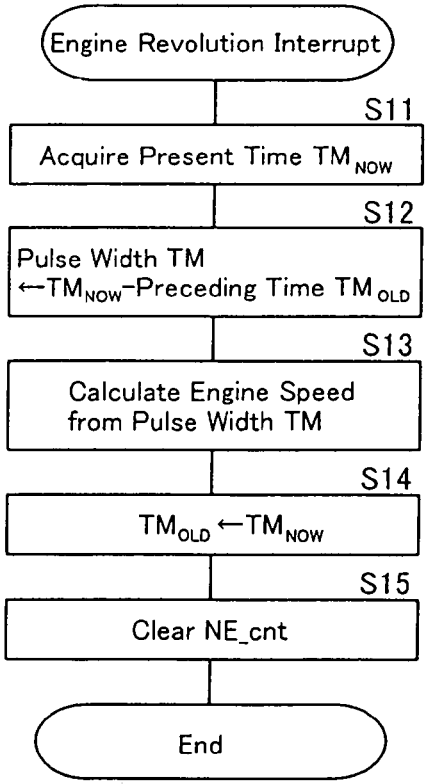
FIG. 7 is a flowchart showing a processing operation performed by the microcomputer of the power management device according to the first embodiment.

A processing operation [1-2] performed by the microcomputer 22 of the power management device 21 according to the first embodiment is described below with a flowchart shown in FIG. 7. Here, this processing operation [1-2] is interrupt processing performed when an engine revolution pulse sent form the engine control device 31 was received.

When receiving an engine revolution signal sent form the engine control device 31, the present time $TM_{NOW}$ is acquired (Step S11). By subtracting the preceding time $TM_{OLD}$ from the present time $TM_{NOW}$, an elapsed time TM (i.e. a pulse width) is calculated (Step S12). From this pulse width, an engine speed is calculated (Step S13). Then, the preceding time $TM_{OLD}$ is updated to the present time $TM_{NOW}$ (Step S14), and a timer counter NE_cnt for measuring a time during which no engine revolution signal is detected is cleared (Step S15).

Figure 8:
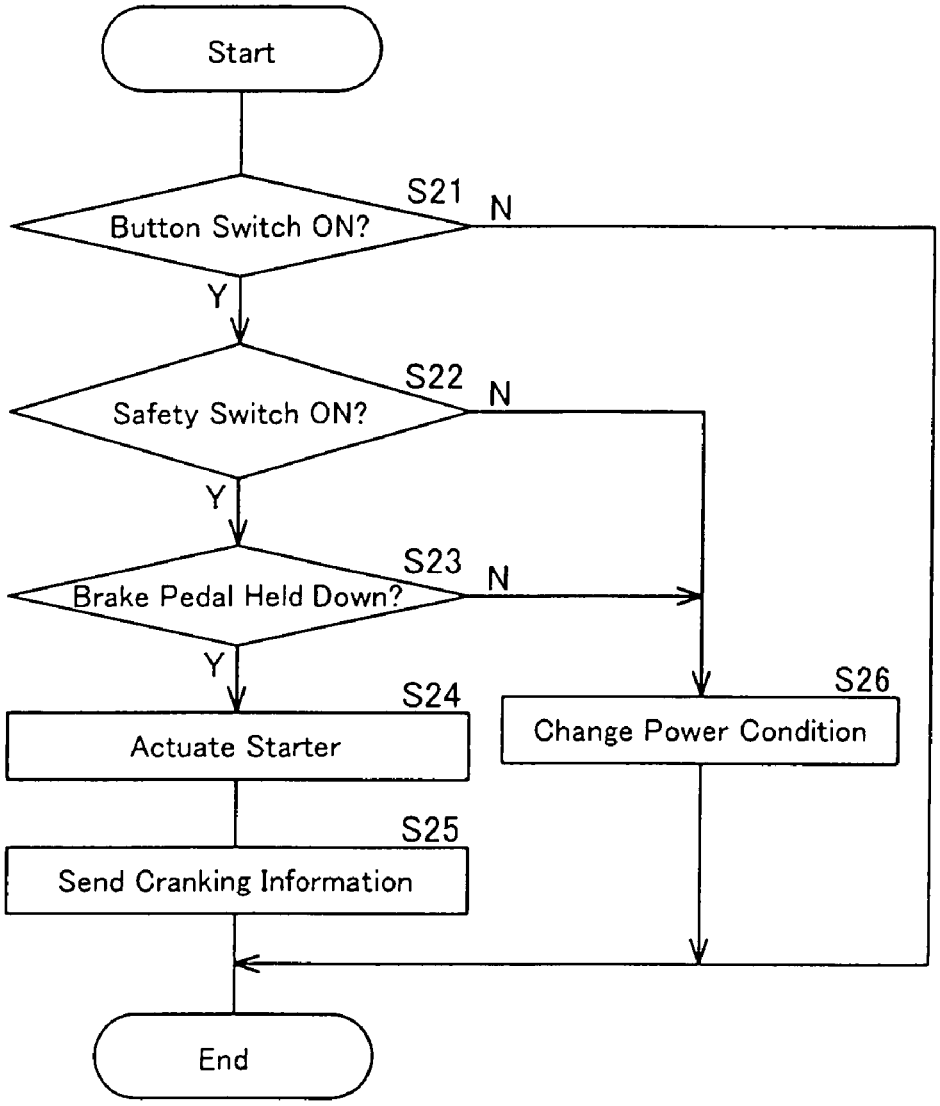
FIG. 8 is a flowchart showing a processing operation performed by the microcomputer of the power management device according to the first embodiment.

A processing operation [1-3] performed by the microcomputer 22 of the power management device 21 according to the first embodiment is described below with a flowchart shown in FIG. 8. Here, this processing operation [1-3] is conducted at every prescribed interval. Whether the button switch 9 is in an ON state or not is judged (Step S21).

When it is judged that the button switch 9 is in the ON state, whether the safety switch 6 is in an ON state or not is judged (Step S22). When it is judged that the safety switch 6 is in the ON state, whether the brake pedal is held down or not is judged based on a signal obtained from a brake switch 10 (Step S23). On the other hand, when it is judged that the button switch 9 is not in the ON state in Step S21, the processing operation [1-3] is concluded at once.

When it is judged that the brake pedal is held down in Step S23, it is assumed that a condition for starting the engine is satisfied. Power is applied to the coils $L_2$, $L_3$ and $L_7$ to turn on the ACC relay 2, the IG relay 3 and the ST relay 7, so as to actuate the starter motor 4 (Step S24). Then, cranking information is sent through the transceiver 26 to the engine control device 31 (Step S25).

On the other hand, when it is judged that the safety switch 6 is not in the ON state, or when it is judged that the brake pedal is not held down, the power condition is changed (Step S26). When the power is in an OFF state, power is applied to the coil $L_2$, leading to an ACC state. When the power is in the ACC state, power is applied to the coil $L_3$, leading to an IG state. When the power is in the IG state, power to the coils $L_2$ and $L_3$ is cut off, leading to the OFF state.

Figure 9:
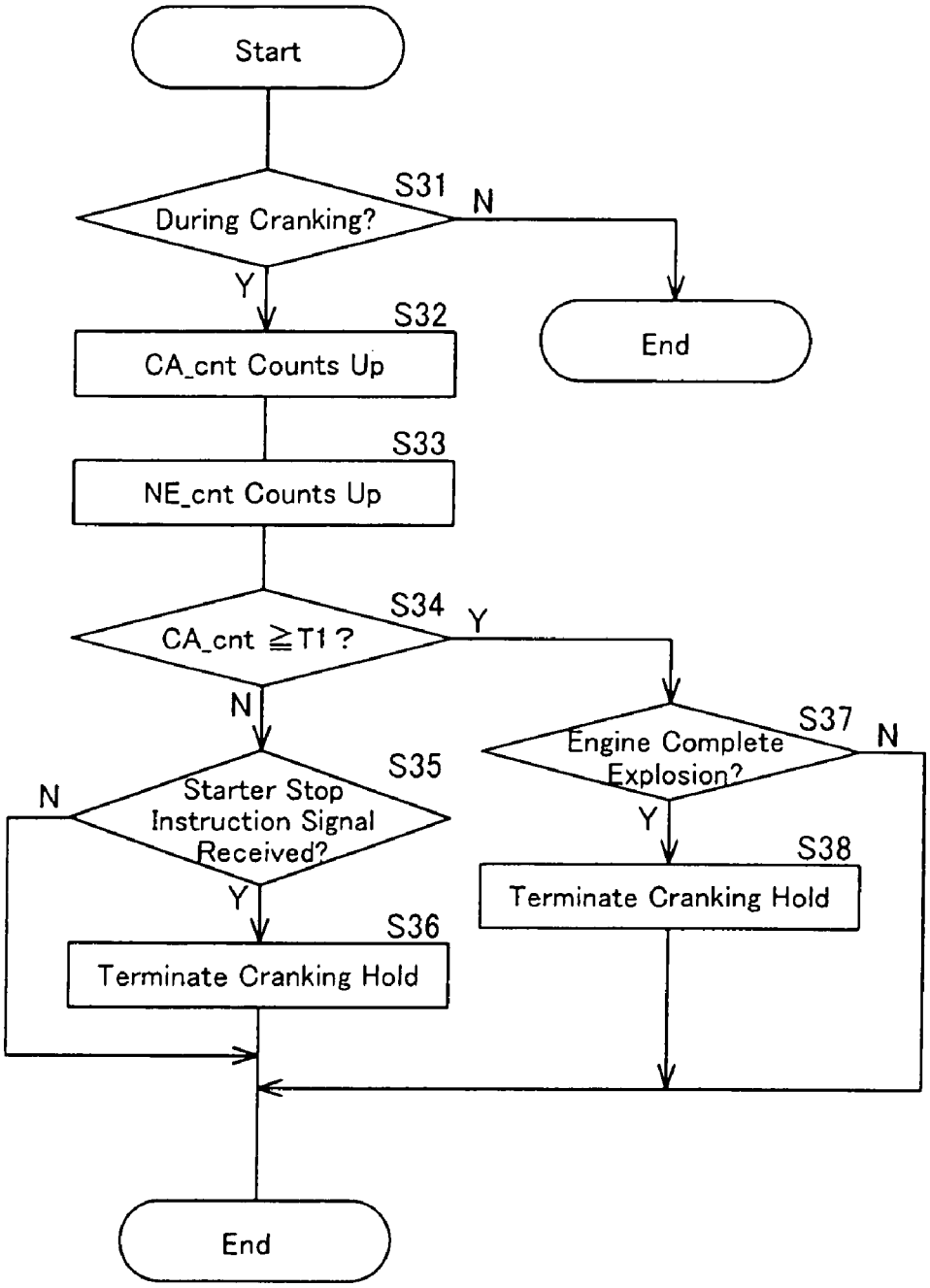
FIG. 9 is a flowchart showing a processing operation performed by the microcomputer of the power management device according to the first embodiment.

A processing operation [1-4] performed by the microcomputer 22 of the power management device 21 according to the first embodiment is described below with a flowchart shown in FIG. 9. Here, this processing operation [1-4] is conducted at every prescribed interval. Whether the starter has been actuated or not is judged (Step S31).

When it is judged that the starter has been actuated, both the timer counter CA_cnt for measuring a time during which no communication data is received and the timer counter NE_cnt for measuring a time during which no engine revolution signal is detected are caused to count up (Steps S32 and S33). Then, whether the timer counter CA_cnt has counted to a predetermined time T1 (e.g. 36 msec) or more is judged (Step S34). As shown in FIG. 6, when communication data was received, the timer counter CA_cnt is cleared. Therefore, in cases where the timer counter CA_cnt has counted to the predetermined time T1 or more, it is suspected that an abnormal condition has been caused in the communication system such as the transceivers 26 and 35.

When it is judged that the timer counter CA_cnt has not counted to the predetermined time T1 or more, whether a starter stop instruction signal to be sent from the engine control device 31 when it is determined that the engine reached a complete explosion was received or not is judged (Step S35). When it is judged that a starter stop instruction signal sent from the engine control device 31 was received (i.e. the engine has reached a complete explosion), the application of power to the coil $L_7$ is cut off, so as to terminate cranking hold (Step S36). On the other hand, when it is judged that no starter stop instruction signal has been received, the processing operation [1-4] is concluded at once since there is no need to terminate cranking hold.

When it is judged that the timer counter CA_cnt has counted to the predetermined time T1 or more (there is a high possibility of an occurrence of an abnormal condition in the communication system) in Step S34, whether or not the engine speed is a prescribed value (e.g. 800 rpm) or more so that the engine can be regarded as having reached a complete explosion is judged (Step S37).

When it is judged that the engine speed is the prescribed value or more, the engine is regarded as having reached a complete explosion. The application of power to the coil $L_7$ is cut off so as to terminate cranking hold (Step S38). On the other hand, when it is judged that the engine speed is less than the prescribed value, the processing operation [1-4] is concluded at once since there is no need to terminate cranking hold. When it is judged that the starter has not been actuated in Step S31, the processing operation [1-4] is concluded at once since there is no need to conduct processing thereafter.

Here, the timer counter CA_cnt and the timer counter NE_cnt are caused to count up in the processing operation [1-4] (i.e. count up by soft processing). But they may be caused to count up by using an auto-increment function supported as a function of hardware (microcomputer), resulting in an omission of the soft processing.

Figure 10:
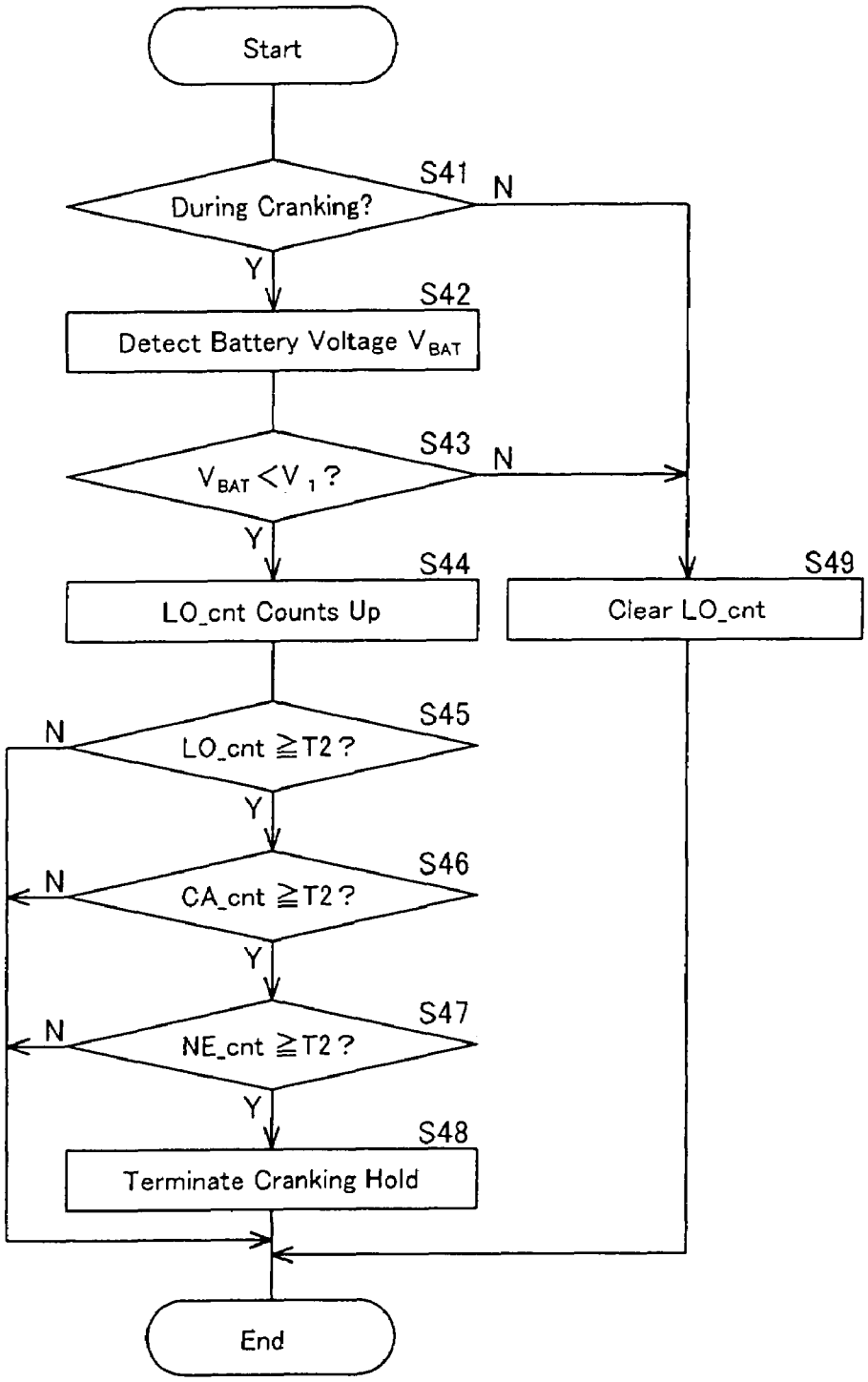
FIG. 10 is a flowchart showing a processing operation performed by the microcomputer of the power management device according to the first embodiment.

A processing operation [1-5] performed by the microcomputer 22 of the power management device 21 according to the first embodiment is described below with a flowchart shown in FIG. 10. Here, this processing operation [1-5] is conducted at every prescribed interval. Whether the starter has been actuated or not is judged (Step S41).

When it is judged that the starter has been actuated, a battery voltage $V_{BAT}$ detected by the voltage sensor 16 is acquired (Step S42), and whether the battery voltage $V_{BAT}$ is below a prescribed value $V_1$ or not is judged (Step S43). The prescribed value $V_1$ is within an operating voltage range of the engine control device 31 or below, and is set to be within the operating voltage range thereof, for example, It is desired that the prescribed value $V_1$ should be set to be around the lower limit of the operating voltage range of the engine control device 31. Here, the prescribed value $V_1$ is set to be within the operating voltage range of the engine control device 31 or below, but the prescribed value $V_1$ may be set to be larger than the operating voltage range of the engine control device 31.

In addition, when comparing the microcomputer 32 constituting the engine control device 31 with the transceiver 35 as a communication unit, it is considered that an operating voltage range of the transceiver 35 is higher than an operating voltage range of the microcomputer 32. Therefore, the prescribed value $V_1$ is preferably set to be within the operating voltage range of the transceiver 35.

When it is judged that the battery voltage $V_{BAT}$ is below the prescribed value $V_1$ (i.e. the battery voltage $V_{BAT}$ is below the operating voltage range of the engine control device 31, and therefore, there is a possibility that the engine control device 31 may be unable to normally operate), a timer counter LO_cnt for measuring a time during which the battery 1 is in a low voltage state is caused to count up (Step S44). Thereafter, whether the timer counter LO_cnt has counted to a predetermined time T2 (e.g. 100 msec) or more is judged (Step S45). Here, it is desired that the predetermined time T2 should be set to be a time required for the engine control device 31 to return after reset (e.g. 100 msec) or more.

When it is judged that the timer counter LO_cnt has counted to the predetermined time T2 or more, whether the timer counter CA_cnt has counted to the predetermined time T2 or more is judged (Step S46). When it is judged that the timer counter CA_cnt has counted to the predetermined time T2 or more, whether the timer counter NE_cnt has counted to the predetermined time T2 or more is judged (Step S47).

When it is judged that the timer counter NE_cnt has counted to the predetermined time T2 or more, it is judged that a condition where the engine control device 31 is unable to normally operate will continue, resulting in a low possibility that either of a starter stop instruction signal and an engine revolution signal may be sent from the engine control device 31. And the application of power to the coil $L_7$ is cut off so as to terminate cranking hold (Step S48). That makes it possible to prevent the starter motor 4 from continuing to act even though the engine has reached a complete explosion.

On the other hand, when it is judged that any of the timer counters LO_cnt, CA_cnt, and NE_cnt has not counted to the predetermined time T2 or more, the cranking is held, and the processing operation [1-5] is concluded at once.

When it is judged that the starter has not been actuated in Step S41, or when it is judged that the battery voltage $V_{BAT}$ is not below the prescribed value $V_1$ in Step S43, the processing operation goes to Step S49, wherein the timer counter LO_cnt is cleared. Thereafter, the processing operation [1-5] is concluded.

By using the power management device according to the first embodiment, cranking hold is forcefully terminated when the battery 1 became in a low voltage state, the battery voltage $V_{BAT}$ decreased below the operating voltage range of the engine control device 31, and therefore, it is judged that a starter stop instruction signal and an engine revolution signal from the engine control device 31 cannot be received. As a result, it is possible to prevent an event where cranking is held for an indefinite time even though the engine has reached a complete explosion, leading to a failure of the starter motor 4, or an occurrence of an unusual sound, which causes user discomfort.

A power management device according to a second embodiment is described below. Here, since a construction of a push start system comprising the power management device according to the second embodiment is similar to that of the push start system shown in FIG. 4 except the power management device 21 and the microcomputer 22, the power management device and a microcomputer are differently marked and other components are not described below.

The microcomputer 22A of the power management device 21A according to the second embodiment performs processing operations [2-1]-[2-4] similar to the processing operations [1-1]-[1-4] performed by the microcomputer 22 shown in FIGS. 6-9. The microcomputer 22A can terminate cranking hold when receiving a starter stop instruction signal sent from an engine control device 31. And even if the starter stop instruction signal cannot be received, the microcomputer 22A can terminate cranking hold based on an engine speed.

Figure 11:
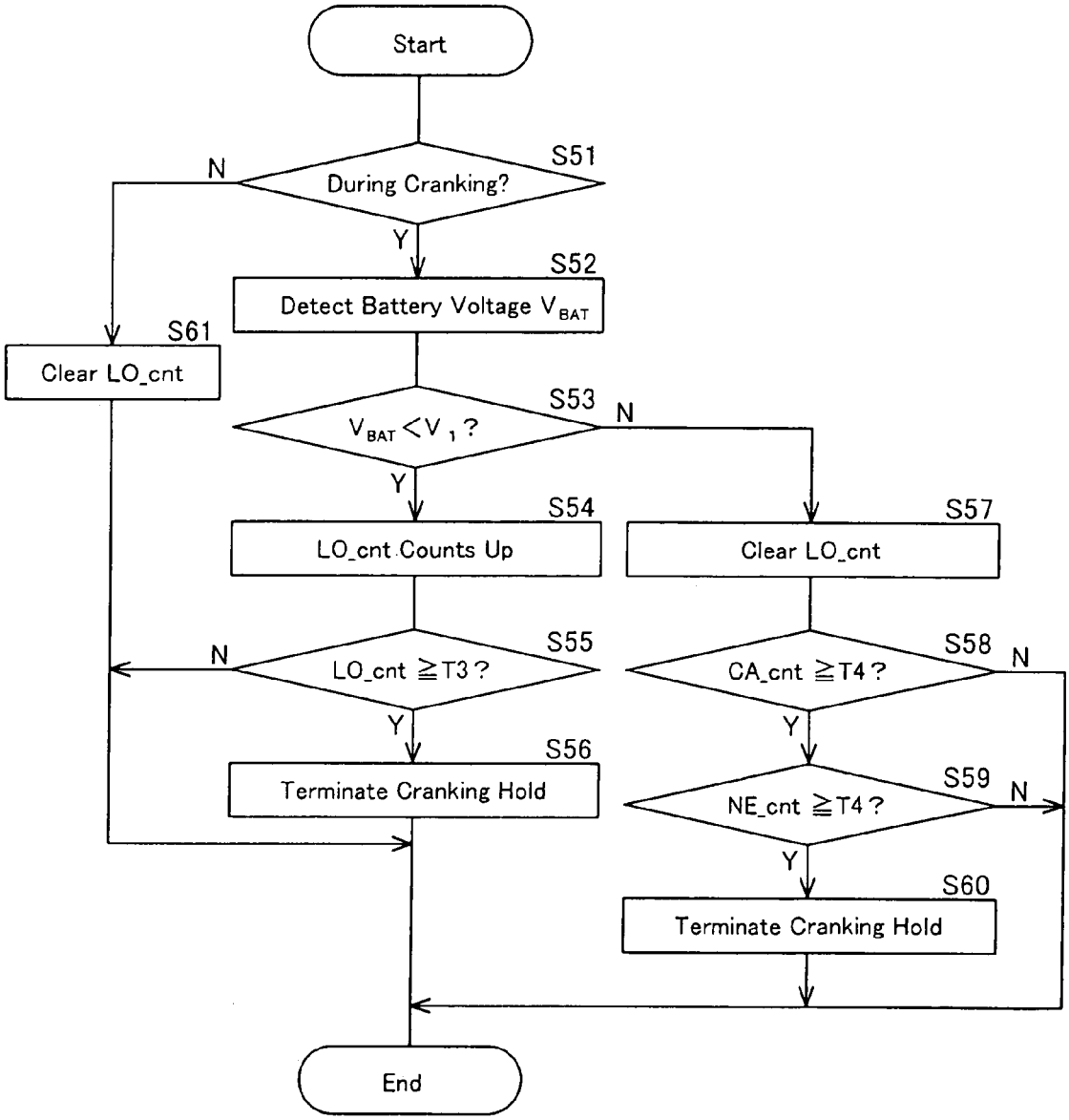
FIG. 11 is a flowchart showing a processing operation performed by the microcomputer of the power management device according to the first embodiment.

A processing operation [2-5] performed by the microcomputer 22A of the power management device 21A according to the second embodiment is described below with a flowchart shown in FIG. 11. Here, this processing operation [2-5] is conducted at every prescribed interval. Whether a starter has been actuated or not is judged (Step S51).

When it is judged that the starter has been actuated, a battery voltage $V_{BAT}$ detected by a voltage sensor 16 is acquired (Step S52), and whether the battery voltage $V_{BAT}$ is below a prescribed value $V_1$ or not is judged (Step S53). The prescribed value $V_1$ is within an operating voltage range of the engine control device 31 or below, and is set to be within the operating voltage range thereof, for example.

It is desired that the prescribed value $V_1$ should be set to be around the lower limit of the operating voltage range of the engine control device 31. Here, the prescribed value $V_1$ is set to be within the operating voltage range of the engine control device 31 or below, but the prescribed value $V_1$ may be set to be larger than the operating voltage range of the engine control device 31.

In addition, when comparing the microcomputer 32 constituting the engine control device 31 with the transceiver 35 as a communication unit, it is considered that an operating voltage range of the transceiver 35 is higher than an operating voltage range of the microcomputer 32. Therefore, the prescribed value $V_1$ is preferably set to be within the operating voltage range of the transceiver 35.

When it is judged that the battery voltage $V_{BAT}$ is below the prescribed value $V_1$ (i.e. the battery voltage $V_{BAT}$ is below the operating voltage range of the engine control device 31, and therefore, there is a possibility that the engine control device 31 may be unable to normally operate), a timer counter LO_cnt for measuring a time during which a battery 1 is in a low voltage state is caused to count up (Step S54). Thereafter, whether the timer counter LO_cnt has counted to a predetermined time T3 (e.g. 100 msec) or more is judged (Step S55). Here, it is desired that the predetermined time T3 should be set to be a time required for the engine control device 31 to return after reset (e.g. 100 msec) or more.

When it is judged that the timer counter LO_cnt has counted to the predetermined time T3 or more, it is judged that a condition where the engine control device 31 is unable to normally operate will continue, resulting in a low possibility that either of a starter stop instruction signal and an engine revolution signal may be sent from the engine control device 31. And the application of power to a coil $L_7$ is cut off so as to terminate cranking hold (Step S56). On the other hand, when it is judged that the timer counter LO_cnt has not counted to the predetermined time T3 or more, the processing operation [2-5] is concluded at once.

When it is judged that the battery voltage $V_{BAT}$ is not below the prescribed value $V_1$ in Step S53, the timer counter LO_cnt is cleared (Step S57). Thereafter, whether a timer counter CA_cnt has counted to a predetermined time T4 (e.g. 100 msec) or more is judged (Step S58). When it is judged that the timer counter CA_cnt has counted to the predetermined time T4 or more, whether a timer counter NE_cnt has counted to the predetermined time T4 or more is judged (Step S59). Here, it is desired that the predetermined time T4 should be set to be a time required for the engine control device 31 to return after reset (e.g. 100 msec) or more.

When it is judged that the timer counter NE_cnt has counted to the predetermined time T4 or more, it is judged that a condition where the engine control device 31 is unable to normally operate will continue, resulting in a low possibility that either of a starter stop instruction signal and an engine revolution signal may be sent from the engine control device 31. And the application of power to the coil $L_7$ is cut off so as to terminate cranking hold (Step S60).

On the other hand, when it is judged that either of the timer counters CA_cnt and NE_cnt has not counted to the predetermined time T4 or more, the cranking is held, and the processing operation [2-5] is concluded at once. When it is judged that the starter has not been actuated in Step S51, the processing operation goes to Step S61, wherein the timer counter LO_cnt is cleared. Thereafter, the processing operation [2-5] is concluded.

By using the power management device according to the second embodiment, cranking hold is forcefully terminated when the battery 1 became in a low voltage state, the battery voltage $V_{BAT}$ decreased below the operating voltage range of the engine control device 31, and therefore, it is judged that a starter stop instruction signal and an engine revolution signal from the engine control device 31 cannot be received. As a result, it is possible to prevent an event where cranking is held for an indefinite time even though the engine has reached a complete explosion, leading to a failure of a starter motor 4, or an occurrence of an unusual sound, which causes user discomfort.

A power management device according to a third embodiment is described below. Here, since a construction of a push start system comprising the power management device according to the third embodiment is similar to that of the push start system shown in FIG. 4 except the power management device 21 and the microcomputer 22, the power management device and a microcomputer are differently marked and other components are not described below.

The microcomputer 22B of the power management device 21B according to the third embodiment performs processing operations [3-1]-[3-4] similar to the processing operations [1-1]-[1-4] performed by the microcomputer 22 shown in FIGS. 6-9. The microcomputer 22B can terminate cranking hold when receiving a starter stop instruction signal sent from an engine control device 31. And even if the starter stop instruction signal cannot be received, the microcomputer 22B can terminate cranking hold based on an engine speed.

A processing operation [3-5] performed by the microcomputer 22B of the power management device 21B according to the third embodiment is described below with a flowchart shown in FIG. 12. Here, this processing operation [3-5] is conducted at every prescribed interval. Whether a starter has been actuated or not is judged (Step S71).

When it is judged that the starter has been actuated, a battery voltage $V_{BAT}$ detected by a voltage sensor 16 is acquired (Step S72), and whether the battery voltage $V_{BAT}$ is a prescribed value $V_2$ or more is judged (Step S73). The prescribed value $V_2$ is the lower limit of an operating voltage range of the engine control device 31 or more.

When it is judged that the battery voltage $V_{BAT}$ is the prescribed value $V_2$ or more (i.e. the battery voltage $V_{BAT}$ is large enough to guarantee an operation of the engine control device 31, and therefore, the engine control device 31 is able to normally operate), whether a timer counter CA_cnt has counted to a predetermined time T5 (e.g. 36 msec) or more is judged (Step S74). In cases where the engine control device 31 is normally operating, some communication data should be sent from the engine control device 31 every 12 msec.

When it is judged that the timer counter CA_cnt has counted to the predetermined time T5 or more (i.e. no communication data has been sent from the engine control device 31), whether a timer counter NE_cnt has counted to a predetermined time T6 (e.g. 20 msec) or more is judged (Step S75). In cases where the starter has been actuated and the engine control device 31 is normally operating, an engine revolution signal should be sent from the engine control device 31 every 10 msec or so. When the engine speed is 500 rpm, the engine revolution signal is to be sent therefrom at every interval of about 10 msec.

When neither communication data nor an engine revolution signal can be received even though the starter has been actuated and the battery voltage $V_{BAT}$ is the lower limit of the operating voltage range of the engine control device 31 or more (in a situation where the engine control device 31 can normally operate), there is a high possibility of a failure of the engine control device 31.

When it is judged that the timer counter NE_cnt has counted to the predetermined time T6 or more, the engine control device 31 is regarded as having suffered a failure. And a timer counter DG_cnt for measuring a time elapsed after the failure is caused to count up (Step S76), and then, whether the timer counter DG_cnt has counted to a predetermined time T7 (e.g. 100 msec) or more is judged (Step S77).

When it is judged that the timer counter DG_cnt has counted to the predetermined time T7 or more, it is judged that there is a low possibility that the engine control device 31 may return from the failure, and the application of power to a coil $L_7$ is cut off and cranking hold is terminated (Step S78). Thus, by avoiding the starter from being uselessly driven in a faulty state of the engine control device 31, it is possible to restrain degradation of a battery 1.

On the other hand, when it is judged that the timer counter DG_cnt has not counted to the predetermined time T7 or more, the cranking is held and the processing operation [3-5] is concluded at once.

Here, it is desired that the predetermined time T7 should be set to be a time required for the engine control device 31 to return after reset (e.g. 100 msec) or more, in order to prevent cranking hold from being forcefully terminated by a temporary runaway of the microcomputer 32.

When it is judged that the starter has not been actuated in Step S71, or when it is judged that the battery voltage $V_{BAT}$ is less than the prescribed value $V_2$ in Step S73, or when it is judged that the timer counter CA_cnt has not counted to the predetermined time T5 or more in Step S74, or when the timer counter NE_cnt has not counted to the predetermined time T6 or more in Step S75, the processing operation goes to Step S79, wherein the timer counter DG_cnt is cleared, and then, the processing operation [3-5] is concluded.

By using the power management device according to the third embodiment, cranking hold is forcefully terminated when it is judged that the engine control device 31 is in a faulty state. When the engine control device 31 suffers a breakdown and runs away, injection control or ignition control cannot be conducted, and therefore, there is no need to hold cranking. When the starter has been continuously actuated in such situation, a degradation speed of the battery 1 is increased and the life expectancy of the battery 1 is shortened. Consequently, it is possible to restrain battery degradation by avoiding the starter from being uselessly driven.

Here, whether the engine control device 31 is in a faulty state or not is judged based on a driving state of the starter, a state of battery voltage, a reception state of communication data and a reception state of engine revolution signals. However, in another embodiment, whether the engine control device 31 is in a faulty state or not is judged additionally based on a power condition, since the engine control device 31 operates when the power is in an IG state (i.e. if an IG relay 3 is not in an ON state, the engine control device 31 does not operate).

Figure 13:
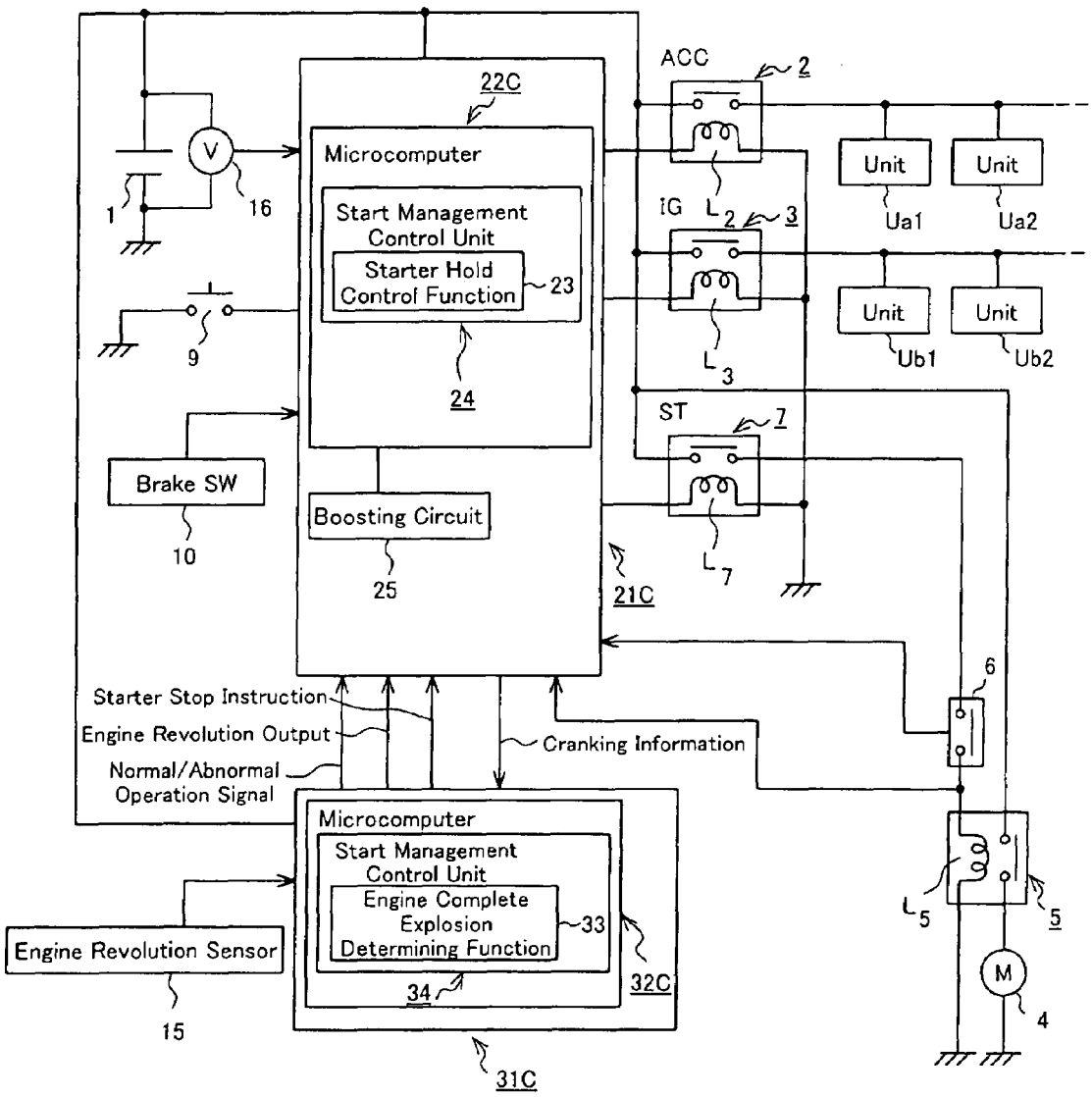
FIG. 13 is a block diagram schematically showing a push start system comprising a power management device according to a fourth embodiment.

FIG. 13 is a block diagram schematically showing a push start system comprising a power management device according to a fourth embodiment. Here, a construction of the push start system comprising the power management device according to the fourth embodiment is similar to that of the push start system shown in FIG. 4 except the power management device 21, the microcomputer 22, the engine control device 31, and the microcomputer 32. Therefore, the power management device, an engine control device, and microcomputers are differently marked and other components are not described below.

Reference numeral 31C in FIG. 13 represents an engine control device, which sends a normal/abnormal operation signal indicating whether the microcomputer 32C is normally operating or not to the power management device 21C. Concretely, while the engine control device 31C is normally operating, a Low-level signal is sent to the power management device 21C at all times. Therefore, when a High-level signal was sent to the power management device 21C from the engine control device 31C, it is admitted that the engine control device 31C is out of order.

Figure 14:
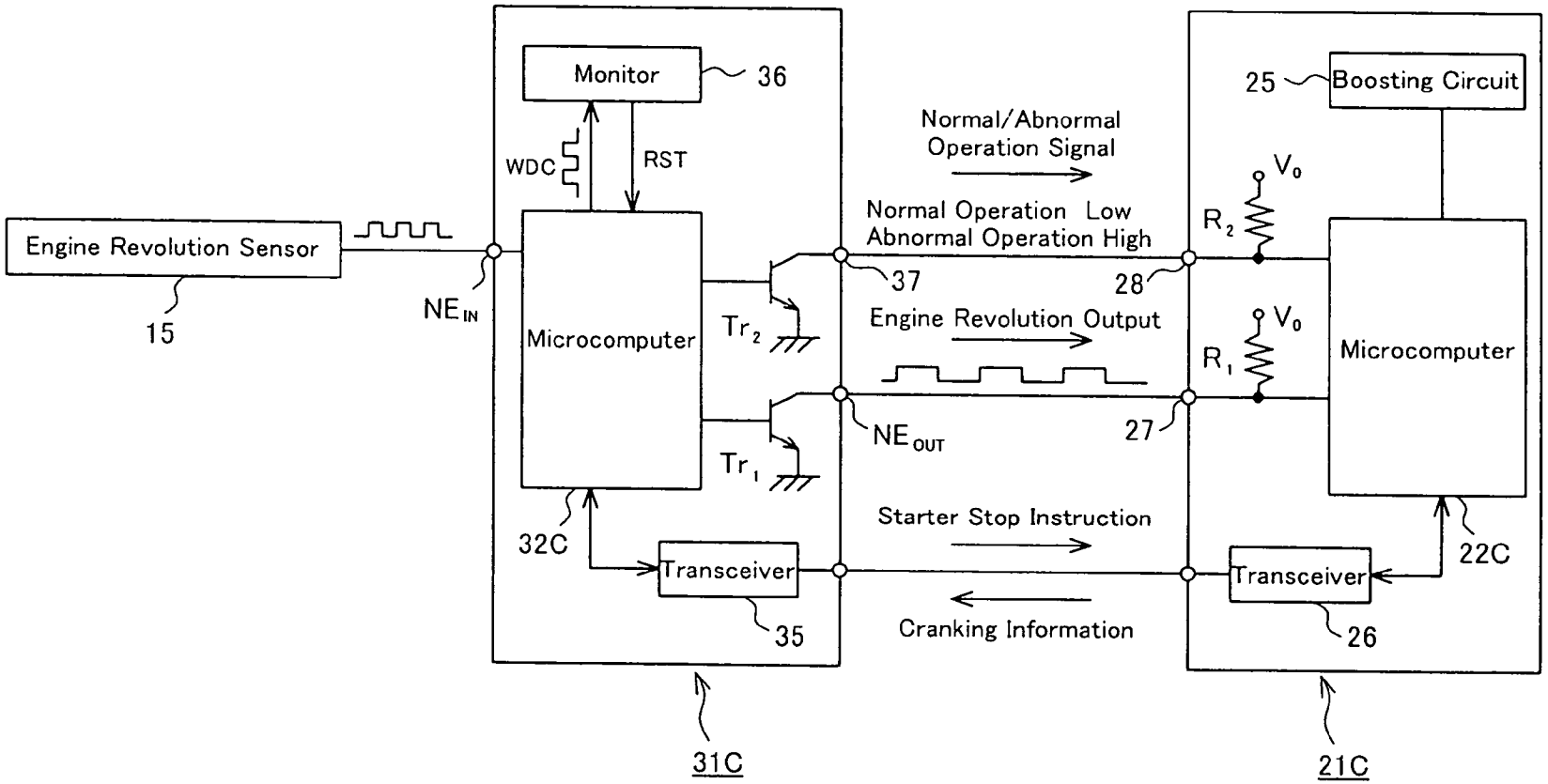
FIG. 14 is a block diagram to describe the power management device according to the fourth embodiment in more detail.

FIG. 14 is a block diagram to describe the power management device and the engine control device according to the fourth embodiment in more detail. Here, the same components as those of the power management device and the engine control device shown in FIG. 5 are similarly marked, and are not described below. The power management device 21C has a microcomputer 22C, a boosting circuit 25, and a transceiver 26, while the engine control device 31C has the microcomputer 32C, a transceiver 35, and a monitor 36 for monitoring whether the microcomputer 32C is normally operating or not.

The microcomputer 32C of the engine control device 31C always outputs a Low-level signal (a normal/abnormal operation signal indicating whether the microcomputer 32C is normally operating or not) through a transistor $Tr_2$ from an output terminal 37. The power management device 21C can receive the normal/abnormal operation signal sent from the engine control device 31C through an input terminal 28. Here, to a line to which the normal/abnormal operation signal is output, a constant voltage power source $V_0$ is connected through a load resistance $R_2$.

The microcomputer 22C of the power management device 21C according to the fourth embodiment performs processing operations [4-1]-[4-4] similar to the processing operations [1-1]-[1-4] performed by the microcomputer 22 shown in FIGS. 6-9. The microcomputer 22C can terminate cranking hold when receiving a starter stop instruction signal sent from the engine control device 31C. And even if the starter stop instruction signal cannot be received, the microcomputer 22C can terminate cranking hold based on an engine speed.

Figure 15:
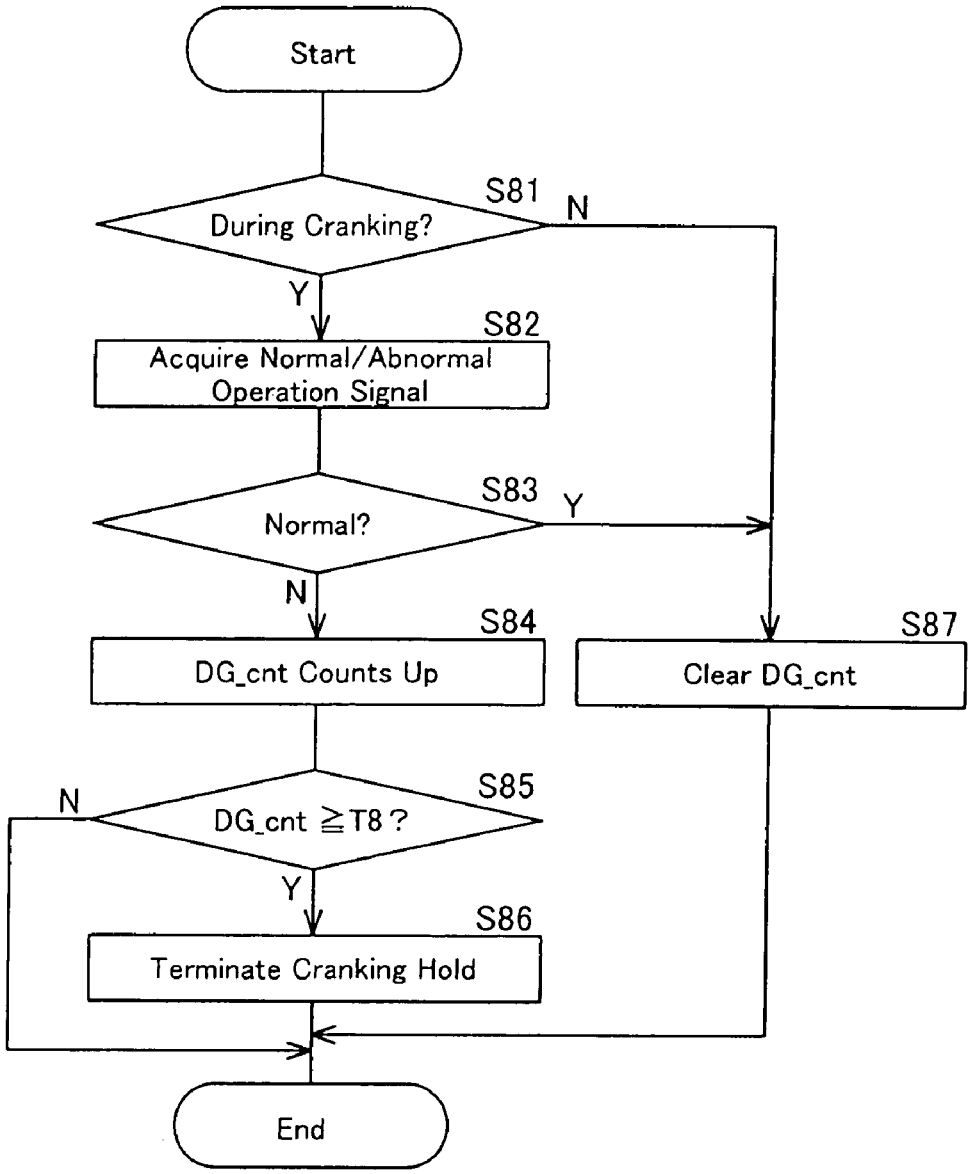
FIG. 15 is a flowchart showing a processing operation performed by a microcomputer of the power management device according to the fourth embodiment.

A processing operation [4-5] performed by the microcomputer 22C of the power management device 21C according to the fourth embodiment is described below with a flowchart shown in FIG. 15. Here, this processing operation [4-5] is conducted at every prescribed interval. Whether a starter has been actuated or not is judged (Step S81).

When it is judged that the starter has been actuated, a normal/abnormal operation signal sent from the engine control device 31C is acquired (Step S82), and whether the microcomputer 32C of the engine control device 31C is normally operating or not is judged (Step S83). It can be judged that the microcomputer 32C is normally operating when the normal/abnormal operation signal is of Low level, and that the microcomputer 32C is in an abnormal condition when the normal/abnormal operation signal is of High level.

When it is judged that the microcomputer 32C of the engine control device 31C is not normally operating (in a state of failure or operation stop), a timer counter DG_cnt for measuring a time elapsed after a failure is caused to count up (Step S84). Thereafter, whether the timer counter DG_cnt has counted to a predetermined time T8 (e.g. 100 msec) or more is judged (Step S85).

When it is judged that the timer counter DG_cnt has counted to the predetermined time T8 or more, it is judged that there is a low possibility that the engine control device 31C may return from the failure, and the application of power to a coil $L_7$ is cut off so as to terminate cranking hold (Step S86). Thus, by avoiding the starter from being uselessly driven in a faulty state of the engine control device 31C, it is possible to restrain degradation of a battery 1.

On the other hand, when it is judged that the timer counter DG_cnt has not counted to the predetermined time T8 or more, the cranking is held and the processing operation [4-5] is concluded at once.

Here, it is desired that the predetermined time T8 should be set to be a time required for the engine control device 31C to return after reset (e.g. 100 msec) or more, in order to prevent cranking hold from being forcefully terminated by a temporary runaway of the microcomputer 32C.

When it is judged that the starter has not been actuated in Step S81, or when it is judged that the microcomputer 32C of the engine control device 31C is normally operating in Step S83, the processing operation goes to Step S87, wherein the timer counter DG_cnt is cleared, and then, the processing operation [4-5] is concluded.

By using the power management device according to the fourth embodiment, cranking hold is forcefully terminated when it is judged that the engine control device 31C is in a faulty state. When the engine control device 31C suffers a breakdown and runs away, injection control or ignition control cannot be conducted, and therefore, there is no need to hold cranking. When the starter has been continuously actuated in such situation, a degradation speed of the battery 1 is increased and the life expectancy of the battery 1 is shortened. Consequently, it is possible to restrain battery degradation by avoiding the starter from being uselessly driven.

Figure 16:
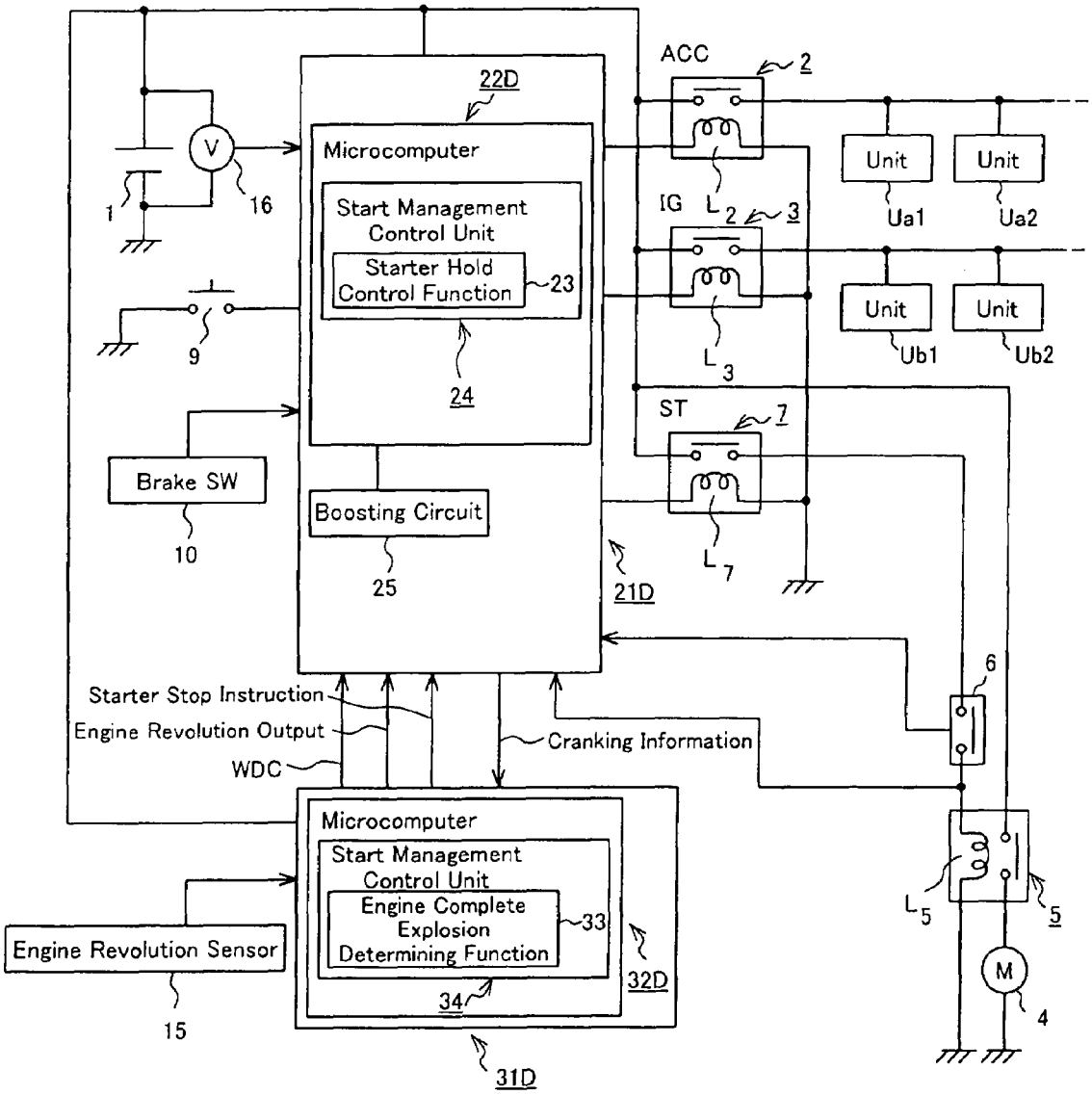
FIG. 16 is a block diagram schematically showing a push start system comprising a power management device according to a fifth embodiment.

FIG. 16 is a block diagram schematically showing a push start system comprising a power management device according to a fifth embodiment. Here, a construction of the push start system comprising the power management device according to the fifth embodiment is similar to that of the push start system shown in FIG. 4 except the power management device 21, the microcomputer 22, the engine control device 31, and the microcomputer 32. Therefore, the power management device, an engine control device, and microcomputers are differently marked and other components are not described below.

Reference numeral 31D in FIG. 16 represents an engine control device, which sends a watchdog signal (WDC) whose pulse is inverted at specified periods to the power management device 21D. In cases where the pulse inversion period is different from the specified period, it is regarded that the microcomputer 32D is not normally operating (i.e. the microcomputer 32D is out of order).

Figure 17:
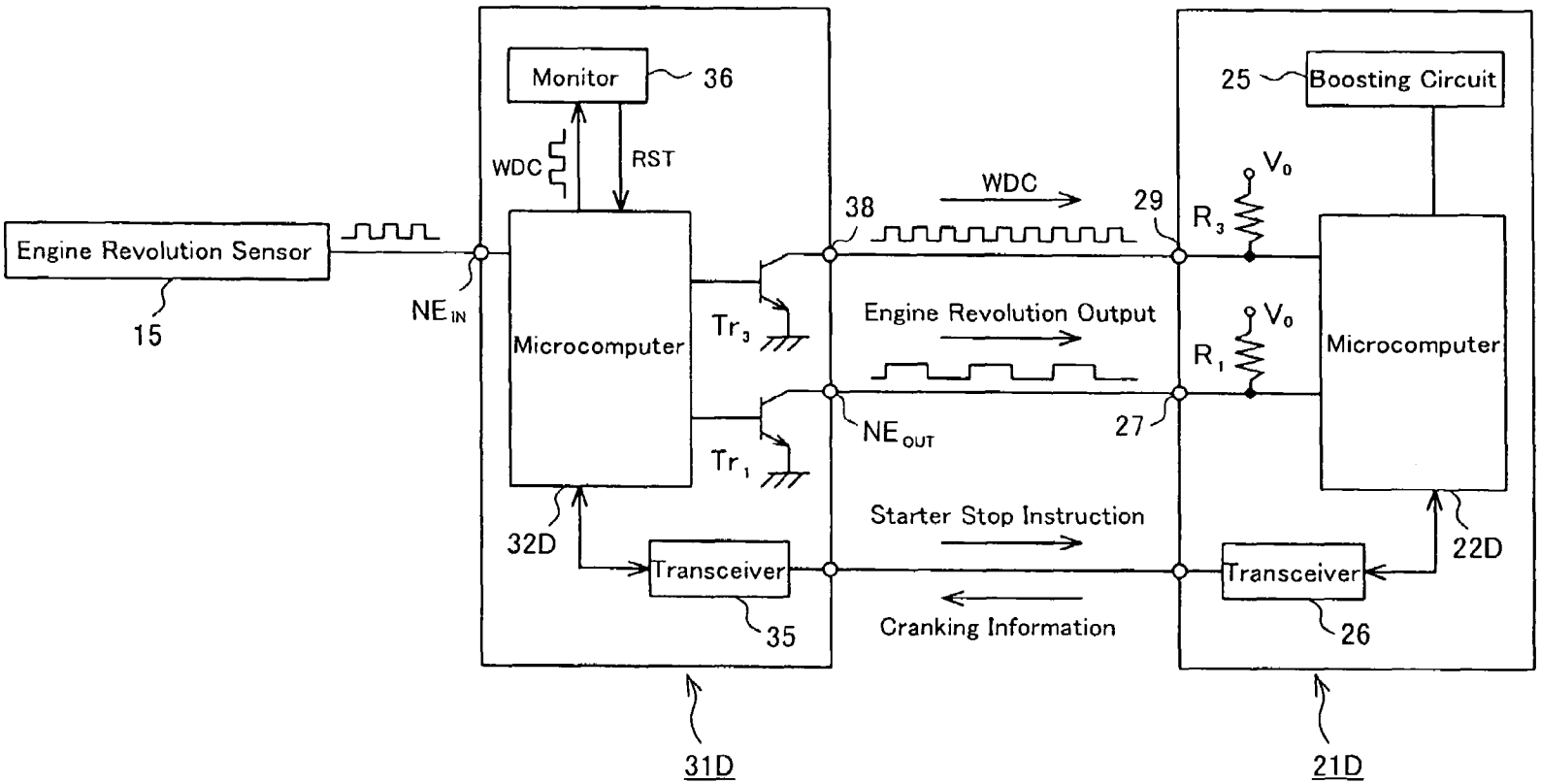
FIG. 17 is a block diagram to describe the power management device according to the fifth embodiment in more detail.

FIG. 17 is a block diagram to describe the power management device and the engine control device according to the fifth embodiment in more detail. Here, the same components as those of the power management device and the engine control device shown in FIG. 5 are similarly marked, and are not described below. The power management device 21D has a microcomputer 22D, a boosting circuit 25, and a transceiver 26, while the engine control device 31D has the microcomputer 32D, a transceiver 35, and a monitor 36 for monitoring whether the microcomputer 32D is normally operating or not.

The microcomputer 32D of the engine control device 31D outputs a WDC which is inverted at specified periods through a transistor $Tr_3$ from an output terminal 38. The power management device 21D can receive the WDC sent from the engine control device 31D through an input terminal 29. Here, to a line to which the WDC is output, a constant voltage power source $V_0$ is connected through a load resistance $R_3$.

The microcomputer 22D of the power management device 21D according to the fifth embodiment performs processing operations [5-1]-[5-4] similar to the processing operations [1-1]-[1-4] performed by the microcomputer 22 shown in FIGS. 6-9. The microcomputer 22D can terminate cranking hold when receiving a starter stop instruction signal sent from the engine control device 31D. And even if the starter stop instruction signal cannot be received, the microcomputer 22D can terminate cranking hold based on an engine speed.

Figure 18:
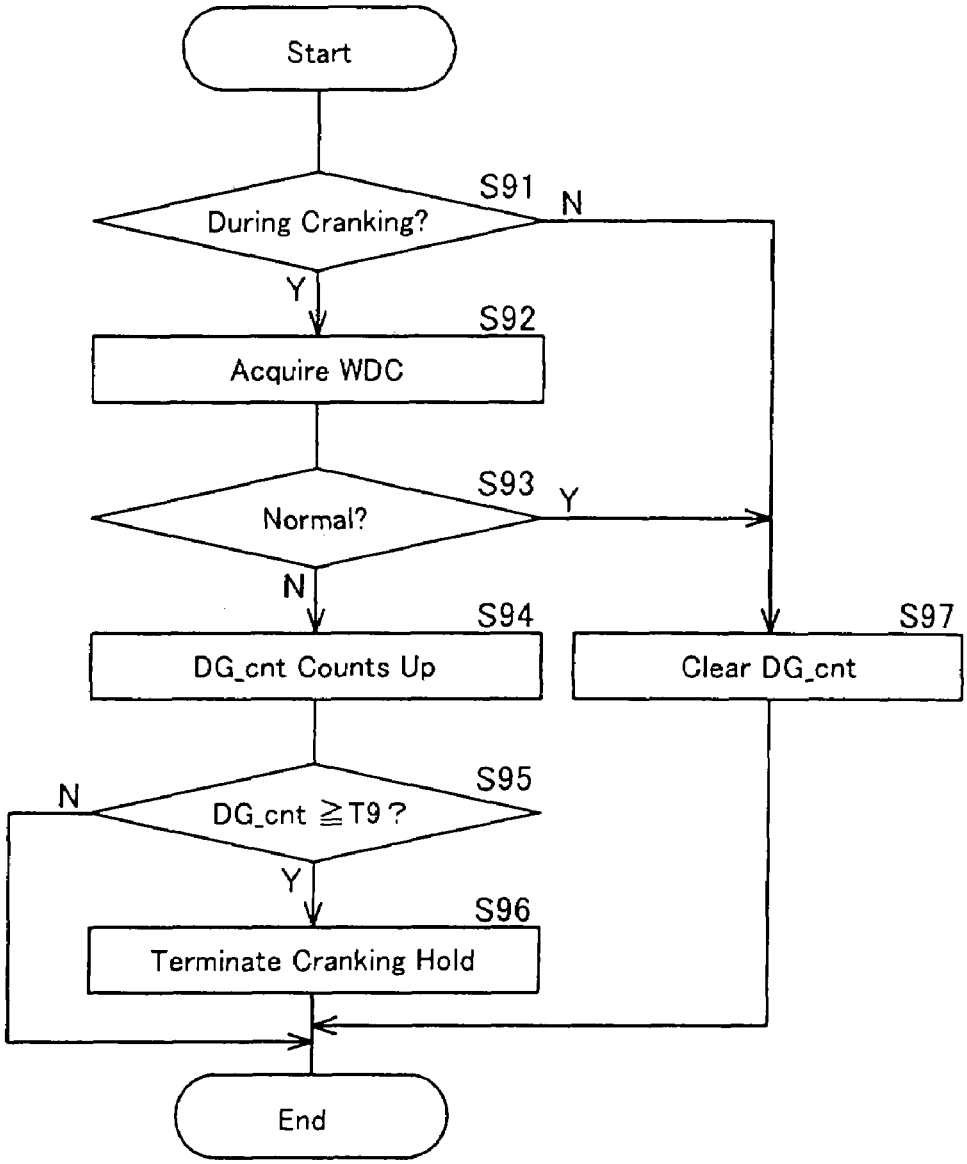
FIG. 18 is a flowchart showing a processing operation performed by a microcomputer of the power management device according to the fifth embodiment.

A processing operation [5-5] performed by the microcomputer 22D of the power management device 21D according to the fifth embodiment is described below with a flowchart shown in FIG. 18. Here, this processing operation [5-5] is conducted at every prescribed interval. Whether a starter has been actuated or not is judged (Step S91).

When it is judged that the starter has been actuated, a WDC sent from the engine control device 31D is acquired (Step S92), and whether the microcomputer 32D of the engine control device 31D is normally operating or not is judged (Step S93). If the microcomputer 32D is normally operating, the WDC is inverted at specified periods.

When it is judged that the microcomputer 32D of the engine control device 31D is not normally operating (is in a faulty state), a timer counter DG_cnt for measuring a time elapsed after a failure is caused to count up (Step S94). Thereafter, whether the timer counter DG_cnt has counted to a predetermined time T9 (e.g. 100 msec) or more is judged (Step S95).

When it is judged that the timer counter DG_cnt has counted to the predetermined time T9 or more, it is judged that there is a low possibility that the engine control device 31D may return from the failure, and the application of power to a coil $L_7$ is cut off so as to terminate cranking hold (Step S96). Thus, by avoiding the starter from being uselessly driven in a faulty state of the engine control device 31D, it is possible to restrain degradation of a battery 1.

On the other hand, when it is judged that the timer counter DG_cnt has not counted to the predetermined time T9 or more, the cranking is held and the processing operation [5-5] is concluded at once.

Here, it is desired that the predetermined time T9 should be set to be a time required for the engine control device 31D to return after reset (e.g. 100 msec) or more, in order to prevent cranking hold from being forcefully terminated by a temporary runaway of the microcomputer 32D.

When it is judged that the starter has not been actuated in Step S91, or when it is judged that the microcomputer 32D of the engine control device 31D is normally operating in Step S93, the processing operation goes to Step S97, wherein the timer counter DG_cnt is cleared, and then, the processing operation [5-5] is concluded.

By using the power management device according to the fifth embodiment, cranking hold is forcefully terminated when it is judged that the engine control device 31D is in a faulty state. When the engine control device 31D suffers a breakdown and runs away, injection control or ignition control cannot be conducted, and therefore, there is no need to hold cranking. When the starter has been continuously actuated in such situation, a degradation speed of the battery 1 is increased and the life expectancy of the battery 1 is shortened. Consequently, it is possible to restrain battery degradation by avoiding the starter from being uselessly driven.

When the power management devices according to the first to fifth embodiments are used, cranking hold is forcefully terminated when it is judged that cranking should not be held because of a large drop in voltage of the battery 1 or the like (Steps S48, S56, S60, S78, S86 and S96). However, by using a power management device according to another embodiment, it may be accepted that cranking hold is not terminated with priority given to a user's intention when a button switch 9 is in an ON state.

Moreover, when cranking hold is forcefully terminated, it is desired that the user should be notified of the termination. By notification, it is possible to allow the user to know that cranking is not held, and urge the user to continue the operation of the button switch 9. As a method for notification, voice guidance, beeps, display guidance, and warning display are exemplified. Not only that cranking cannot be held, but also a reason why cranking cannot be held and what to do may be concretely described.

Figure 12:
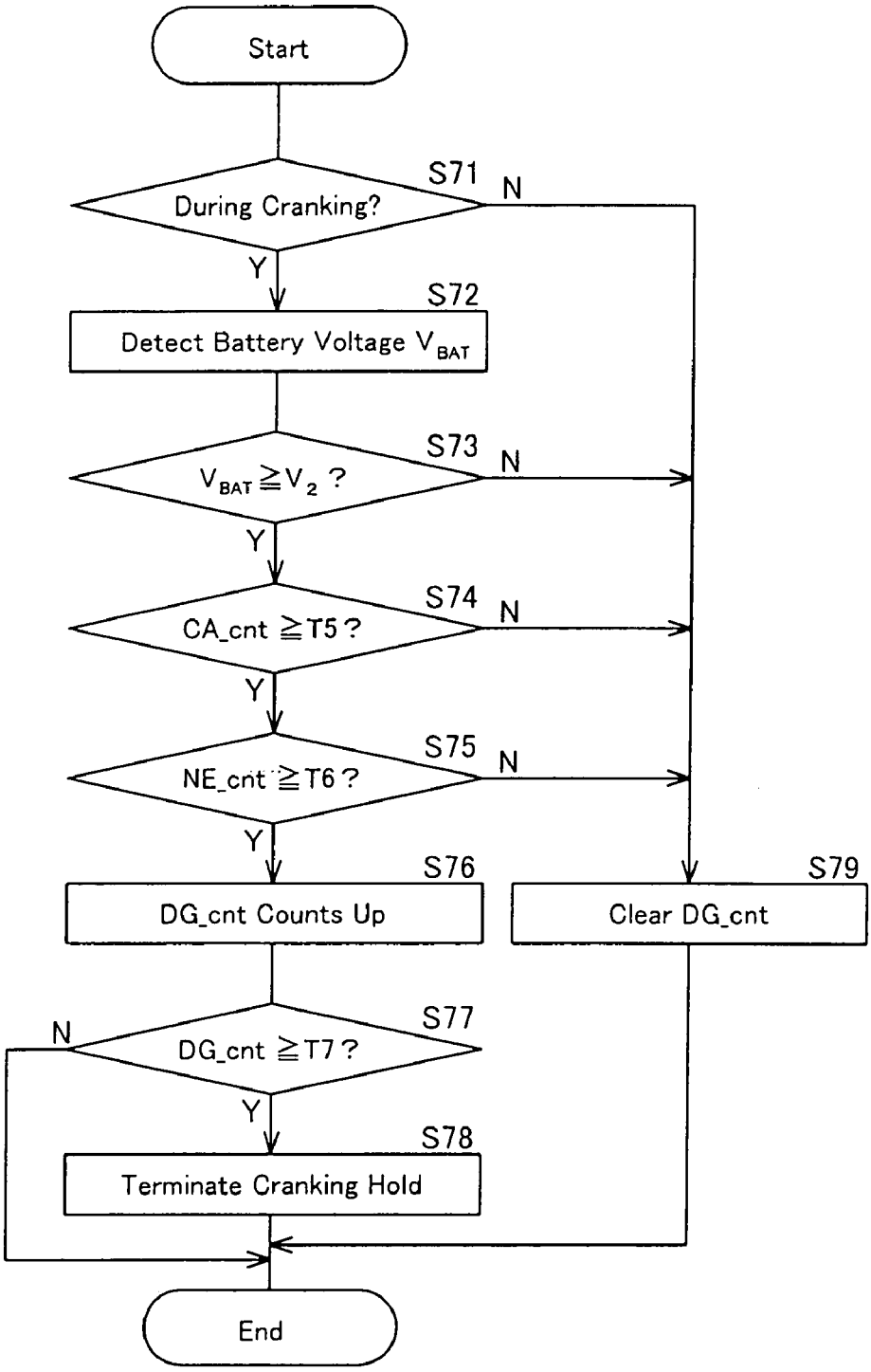
FIG. 12 is a flowchart showing a processing operation performed by the microcomputer of the power management device according to the first embodiment.

It is desired that the predetermined times T2-T9 should be set in consideration of a time required for the microcomputer to return after reset, as described above (however, the predetermined times T5 and T6 used in the processing operation [3-5] shown in FIG. 12 need not be set in consideration of a time required for the microcomputer to return after reset only if the predetermined time T7 is set in consideration of the time, since the predetermined times T5 and T6 are included in the prescribed time T7).

However, characteristics of a microcomputer vary depending on the systems. For example, when comparing a vehicle wherein a mechanical throttle is adopted with a vehicle wherein an electronic throttle is adopted, more data should be initialized in the latter and therefore, a time required for the microcomputer to return after reset is longer. Accordingly, it is desired that the predetermined times T1-T9 should be changed in each system. For example, predetermined times for each system may be stored in an EEPROM and predetermined times corresponding to the system may be read from the EEPROM for use.

Up to now, cases where the power management device, the control system, and the control method according to the present invention are adopted in a push start system were described. However, the power management device, the control system, and the control method according to the present invention are not adopted only in push start systems. They are effective in systems wherein a starter for starting an engine is brought to cranking and the cranking need be stopped with appropriate timing (e.g. an economy running system).

What is claimed is:

1. A power management device, comprising:

a cranking control unit operable to bring a starter for starting an engine to cranking and hold the cranking based on an operating signal output with an operation of a switch;

a first hold terminating unit operable to terminate cranking hold when receiving a starter stop instruction signal indicating an instruction to terminate cranking hold sent from an engine control device when it is determined that the engine reached a complete explosion;

a second hold terminating unit operable to terminate cranking hold when it is determined that the engine reached a complete explosion based on an engine revolution signal sent from the engine control device;

a judging unit for judging whether or not cranking hold can be terminated by the first hold terminating unit or the second hold terminating unit; and a third hold terminating unit operable to terminate cranking hold when it is judged by the judging unit that cranking hold can be terminated by neither the first hold terminating unit nor the second hold terminating unit.

2. A power management device according to claim 1, wherein the judging unit judges that cranking hold can be terminated by neither the first hold terminating unit nor the second hold terminating unit, when a first condition where a battery voltage is below a prescribed value is satisfied; or when a second condition where data is not received from a communication line for sending the starter stop instruction signal and the engine revolution signal is not received is satisfied; or when both the first condition and the second condition are satisfied.

3. A power management device according to claim 1, wherein the judging unit judges that cranking hold can be terminated by neither the first hold terminating unit nor the second hold terminating unit, when a first condition where a battery voltage is below a prescribed value has been satisfied for a first predetermined time; or when a second condition where data is not received from a communication line for sending the starter stop instruction signal and the engine revolution signal is not received has been satisfied for a second predetermined time; or when both the first condition and the second condition have been satisfied for a third predetermined time.

4. A control system, comprising:

an engine control device which comprises:

a first sending unit for sending a starter stop instruction signal indicating an instruction to terminate cranking hold when it is determined that an engine reached a complete explosion; and a second sending unit for sending an engine revolution signal; and a power management device which comprises:

a cranking control unit operable to bring a starter for starting the engine to cranking and hold the cranking based on an operating signal output with an operation of a switch;

a first hold terminating unit operable to terminate cranking hold when receiving the starter stop instruction signal sent from the engine control device;

a second hold terminating unit operable to terminate cranking hold when it is determined that the engine reached a complete explosion based on the engine revolution signal sent from the engine control device;

a judging unit for judging whether or not cranking hold can be terminated by the first hold terminating unit or the second hold terminating unit; and a third hold terminating unit operable to terminate cranking hold when it is judged by the judging unit that cranking hold can be terminated by neither the first hold terminating unit nor the second hold terminating unit.

5. A control method, comprising:

a first step of bringing a starter for starting an engine to cranking and holding the cranking based on an operating signal output with an operation of a switch;

a second step of terminating cranking hold when receiving a starter stop instruction signal indicating an instruction to terminate cranking hold sent from an engine control device when it is determined that the engine reached a complete explosion;

a third step of terminating cranking hold when it is determined that the engine reached a complete explosion based on an engine revolution signal sent from the engine control device;

a fourth step of judging whether or not cranking hold can be terminated through the second step or the third step; and a fifth step of terminating cranking hold when it is judged that cranking hold can be terminated through neither the second step nor the third step.

* * * * *